US011359868B2

(12) United States Patent
Eldred et al.

(10) Patent No.: US 11,359,868 B2
(45) Date of Patent: Jun. 14, 2022

(54) ULTRA-COMPACT THIN FOIL HEAT-EXCHANGER

(71) Applicant: Makai Ocean Engineering, Inc., Waimanalo, HI (US)

(72) Inventors: Michael Eldred, Kailua-Kona, HI (US); Adam Landherr, Stewartville, MN (US); Eric Takasugi, Kailua-Kona, HI (US); In Chieh Chen, Gansevoort, NY (US); Nick Poleshaj, Kailua-Kona, HI (US)

(73) Assignee: MAKAI OCEAN ENGINEERING, INC., Kailua, HI (US)

( * ) Notice: Subject to any disclaimer, the term of this patent is extended or adjusted under 35 U.S.C. 154(b) by 13 days.

(21) Appl. No.: 16/798,989

(22) Filed: Feb. 24, 2020

(65) Prior Publication Data

US 2020/0271387 A1 Aug. 27, 2020

Related U.S. Application Data

(60) Provisional application No. 62/964,875, filed on Jan. 23, 2020, provisional application No. 62/809,994, filed on Feb. 25, 2019.

(51) Int. Cl.

| | |
|---|---|
| ***F28D 9/00*** | (2006.01) |
| ***F28F 3/08*** | (2006.01) |
| *F28F 9/02* | (2006.01) |

(52) U.S. Cl.

CPC ..... *F28D 9/0093* (2013.01); *F28F 3/083* (2013.01); *F28D 9/005* (2013.01); *F28D 9/0043* (2013.01);

(Continued)

(58) Field of Classification Search

CPC ..... F28F 3/083; F28F 9/026; F28D 9/0075; F28D 9/005; F28D 9/0043; F28D 9/0068

See application file for complete search history.

(56) References Cited

U.S. PATENT DOCUMENTS 4,058,980 A * 11/1977 Ahlen ..... F16H 41/24 60/337
5,522,462 A * 6/1996 Kumar ..... F28D 9/005 165/166

(Continued)

FOREIGN PATENT DOCUMENTS

| | | | |
|---|---|---|---|
| KR | 10-2008-0006795 | A | 1/2008 |
| KR | 10-2009-0106160 | A | 10/2009 |
| KR | 10-2011-0002953 | A | 1/2011 |

OTHER PUBLICATIONS

English version of Korean Patent Application No. 10-2009-0106160 dated Oct. 8, 2009 received from the Korean Intellectual Property Office received Jul. 15, 2020.

(Continued)

*Primary Examiner* — Leonard R Leo
(74) *Attorney, Agent, or Firm* — The Marbury Law Group, PLLC

(57) ABSTRACT

Various embodiments include heat exchangers and methods of making heat exchangers from a series of stacked plates each made of two foil sheets bonded together in bonding locations forming fluid flow passages between the foil sheets in regions where the foil sheets are not bonded. An inlet port and an outlet port located at opposite ends of the planar extent of the two foil sheets extend through the foil sheets perpendicular to the planar extent of the foil sheets. The inlet and outlet ports provide access for a first fluid to flow into or out of the internal plate passages formed between the two foil sheets. Interstitial channels are formed between the series of plates and configured to allow the flow of a second (Continued)

fluid between the series of plates, allowing heat to be transferred between the two fluids while isolating the two fluids from one another.

24 Claims, 20 Drawing Sheets

(52) U.S. Cl.
CPC ..... *F28D 9/0068* (2013.01); *F28D 9/0075* (2013.01); *F28F 9/026* (2013.01)

(56) References Cited

U.S. PATENT DOCUMENTS

| | | | | |
|---|---|---|---|---|
| 5,913,361 | A | 6/1999 | Engström et al. | |
| 5,924,484 | A * | 7/1999 | Andersson | F28D 9/005 165/167 |
| 2002/0050347 | A1 * | 5/2002 | Hainley | F28D 9/005 165/167 |
| 2008/0196874 | A1 | 8/2008 | Bertilsson et al. | |
| 2017/0268832 | A1 * | 9/2017 | Christensen | F28F 3/10 |

OTHER PUBLICATIONS

International Search Report and the Written Opinion of the International Searching Authority received from the Korean Intellectual Property Office in related International Application No. PCT/US2020/019595 dated Jun. 19, 2020.

International Preliminary Report on Patentability and Written Opinion of the International Searching Authority received in the International Bureau of WIPO in related International Application No. PCT/US2020/019595 dated Sep. 2, 2021.

* cited by examiner

Section A-A

Section C-C

ULTRA-COMPACT THIN FOIL HEAT-EXCHANGER

RELATED APPLICATIONS

This application claims the benefit of U.S. Provisional Patent Application 62/809,994 entitled "Ultra-Compact Thin Foil Heat-Exchanger," filed Feb. 25, 2019, and U.S. Provisional Patent Application 62/964,875 entitled "Ultra-Compact Thin Foil Heat-Exchanger," filed Jan. 23, 2020, the entire contents of both of which are hereby incorporated by reference for all purposes.

FIELD

The present application relates to heat exchangers, and more particularly to ultra-compact heat exchangers.

BACKGROUND

Some contemporary compact heat exchangers use a corrugated layer of aluminum fins (or other metal) sandwiched between two thin titanium foil sheets that are bonded along the fin crests using laser welding to create a plate-fin heat exchanger. Plate-fin heat exchangers use plates and finned chambers to transfer heat between fluids. The plates and fins are stacked to separate hot and cold streams. The fins serve to increase the heat transfer area and increase the structural integrity of the heat exchanger, allowing it to withstand high pressure. Plate-fin heat exchangers are currently used in many industries, including natural gas liquefaction, cryogenic air separation, ammonia production, offshore processing and Syngas production.

One downside to plate-fin heat exchangers is that the manufacturing and material costs are high. For example, plate-fin heat exchangers are generally formed using a brazing process for bonding the plates and fins that demands high temperatures, which is a costly technique. Additionally, the plate-fin heat exchangers include a manifold welded to the plates, which provides a frame for holding the plates and fins, and provides inlet and outlet ports for fluids. The manifold, which is typically made of metals such as titanium, is a large expensive part of the assembly. The high cost of plate-fin heat exchangers limits their application, meaning that they are generally only used for applications that have an economic advantage in having a reduced size when compared to shell and tube heat exchanger.

SUMMARY

Various embodiments include heat-exchangers that include a series of plates stacked on one another in which each of the plates includes two foil sheets bonded together at a series of spaced apart bonding locations across a planar extent of the two foil sheets in a pattern. Internal plate passages are formed between the two foil sheets that allow the flow of a first fluid between the two foil sheets in regions where the two foil sheets are not bonded. Each of the plates includes an inlet port and an outlet port, each located at opposite ends of the planar extent of the two foil sheets, wherein each of the inlet and outlet ports extend through the two foil sheets perpendicular to the planar extent of the two foil sheets, wherein the inlet and outlet ports provide access for the first fluid to flow into or out of the internal plate passages. In various embodiments, interstitial channels are formed between the series of plates and configured to allow the flow of a second fluid between the series of plates with the first and second fluids isolated from one another.

In some embodiments, the two foil sheets may be between 0.001-0.010 inches thick. In addition, an outer thickness of the two foil sheets with the internal spacer there between may be between 0.2-2.0 millimeters thick. Each of the inlet and outlet ports may be formed by a ring bonded to the two foil sheets and configured to allow the first fluid to flow past a peripheral extent of the ring and through the internal plate passages. The two foil sheets may be made of different material from the ring. A central axis of the inlet and outlet ports of a first one of the series of plates may be offset from a central axis of the inlet and outlet ports of a second one of the series of plates. In some embodiments, the series of plates stacked on one another are bonded together by sealing welds between each of the series of plates. A continuous bond may be formed, in various embodiments, around a perimeter of the two foil sheets for containing the internal fluid.

In some embodiments, each of the plates may further include an internal spacer sandwiched between the two foil sheets at each of the inlet and outlet ports. The internal space may include a connection ring that surrounds an inner diameter of the inlet and outlet ports, and a series of radial teeth that extend radially inward from the connection ring toward the inner diameter of the inlet and outlet ports. In some embodiments, the internal spacer includes an indexing key for maintaining a specific orientation (e.g., rotational and positional) between the internal spacer and the two foil sheets. In some embodiments, each of the two foil sheets includes one or more annular grooves surrounding the inlet and outlet ports, wherein the one or more annular grooves are configured to receive and hold the internal spacer and, in some embodiments, provide a channel for an O-ring to create a seal between the plates during stacking. In some embodiments, each of the plates may further include a gasket mounted on each of the opposed faces of each of the inlet and outlet ports, wherein the gaskets are disposed between the series of plates stacked on one another.

In some embodiments, each of the two foil sheets may include an inner planar surface and a series of inwardly-facing recesses. The inner planar surfaces of the two foil sheets may face toward one another. Also, each of the inwardly-facing recesses may be formed by a depressed portion set back from the inner planar surface. The series of plates may be stacked such that back surfaces of the inwardly-facing recesses in one of the series of plates abut back surfaces of corresponding inwardly-facing recesses in an adjacent other one of the series of plates.

In some embodiments, each of the two foil sheets may include an outer planar surface and a series of outwardly-facing recesses. Each of the outwardly-facing recesses may be formed by a depressed portion set back from the outer planar surface. Also, the two foil sheets may be configured such that a back surface of each of the outwardly-facing recesses in one of the two foil sheets abut a back surface of a corresponding one of the outwardly-facing recesses in the other of the two foil sheets. Each of the series of recesses may include a round perimeter. The depressed portion of each of the series of recesses may include a flat bottom. The abutting series of recesses of the two foil sheets may form spacers between the planar surfaces of the two foil sheets. The series of recesses in each of the two foil sheets may surround the inlet and outlet ports. The recesses in each of the two foil sheets may be arranged in concentric rows.

In some embodiments, a first sheet of the two foil sheets may include a first annular groove having a first open depression and a second sheet of the two foil sheets may include a second annular groove having a second open depression. The first and second annular grooves may be axially aligned relative to a central axis of one of the inlet or outlet ports. The first annular groove may be formed in the first sheet so that the first open depression of the first annular groove faces away from the second sheet when the two foil sheets are assembled. The second annular groove may be formed in the second sheet so that the second open depression of the second annular groove faces toward the first sheet when the two foil sheets are assembled. The first annular groove may include a first depth and the second annular groove may include a second depth that is greater than the first depth. An underside of the second annular groove of a first one of the series of plates may be received inside the first annular groove of a second one of the series of plates. An engagement by the underside of the second annular groove of the first one of the series of plates inside the first annular groove of the second one of the series of plates may deflect a portion of the planar surface of the second sheet of the first one of the series of plates when the heat-exchanger is assembled. An engagement by the underside of the second annular groove of the first one of the series of plates inside the first annular groove of the second one of the series of plates may provide a continuous seal between the first and second ones of the series of plates.

Various embodiments further include methods of making heat exchangers as summarized above.

BRIEF DESCRIPTION OF THE DRAWINGS

The accompanying drawings, which are incorporated herein and constitute part of this specification, illustrate example aspects of various embodiments, and together with the general description given above and the detailed description given below, serve to explain the features of the claims.

DETAILED DESCRIPTION

Various embodiments described herein relate to ultra-compact heat exchangers with improved efficiency and that may be constructed at competitive cost. In particular, various embodiments include a heat exchanger comprising a series of plates stacked on one another. Each of the plates may include two foil sheets bonded together (e.g., by thermal laser welding) at a series of spaced apart bonding locations (e.g., spot welds) across a planar extent of both foil sheets in a pattern. After welding/bonding, the two sheets are expanded away from one another in the non-bonded locations to form internal plate passages configured to allow the flow of a first fluid. An inlet port and an outlet port are welded or bonded to the sheets and configured to provide a fluid access to the internal plate passages. The inlet and outlet ports are located on the sheets, such as at opposite ends of the planar extent of the two foil sheets, to provide a fluid path through the internal plate passages. Such plates are stacked on top of one another to form an assembly that provides interstitial channels between the plates through which a second fluid can flow. O-rings may be positioned in the inlet and outlet ports to separate the first and second fluids. In some embodiments, side structures may be added or formed through sequential welding to contain the second fluid. Compact heat exchangers according to various embodiments may be light weight with a thin profile, inexpensive to manufacture, exhibit efficient heat transfer, and can be formed in a wide variety of shapes and sizes.

As used herein, the term "foil" refers to a very thin sheet of metal, such as titanium or aluminum.

As used herein, the term "ring" refers to a closed shape or figure defined by line segments and/or curves that are connected or meet. The line segments and/or curves start and end at the same point. Although various embodiments are illustrated and described as having circular closed-shaped inlet and outlet ports, such ports can be formed in any closed-shape such as elliptical, square, triangular, and other polygonal shapes, either regular or irregular. The capability of forming inlet and outlet ports in any closed-shape enables compact heat exchangers according to various embodiments to be form-fitted or customized for particular applications, such as positioning a heat exchanger within an odd shaped volume.

Figure 1:
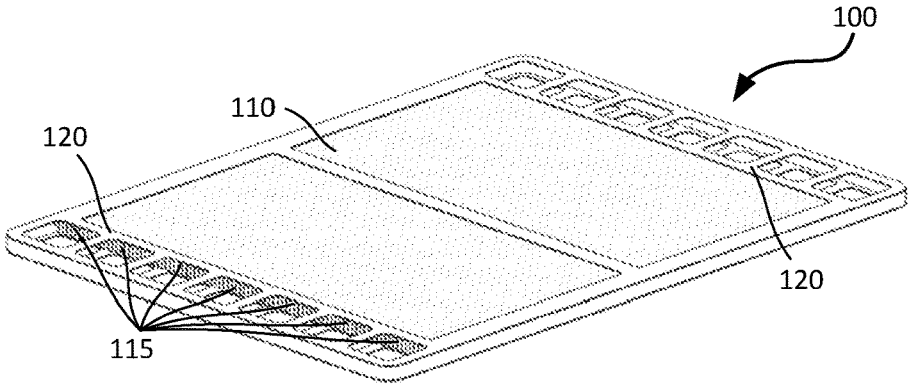
(Prior Art) FIG. 1
FIG. 1 is an isometric view of a prior art foil-fin modular plate with stacked multi-port axial manifold plate construction.

FIG. 1 illustrates prior art heat exchangers that are formed from a number of plates 100, are formed with fins 115 bonded with epoxy to the top and bottom of two sheets 110. This assembly is held within a frame 120. The plates 100 are then stacked, using spacer bars, creating alternating layers for fluid passage. A full plate-fin heat exchanger would be made up of many layers of plates 100. Each layer may be relatively thin compared to their length and width.

The frame 120 may be a pre-machined manifold, constructed of relatively thick titanium plate that runs the length of the heat exchanger and is welded to the top and bottom surfaces of the two foil sheets 110. Several inlet ports are included along the length of the frame 120, which allow fluids such as refrigerants in vapor-cycle systems, water or other liquids to pass down a stack of heat exchangers and through the flow channels between the welded plates 100.

A key design consideration for heat exchangers is efficiency in transferring heat between two fluids. Additionally, ammonia and vapor cycle heat exchangers are designed to withstanding the pressures in excess of 250 psi by the ASME code. Thus, the formed plates of ammonia heat exchangers are designed with sufficient strength to hold this elevated pressure. The plates are also designed with sufficient margin to hold this pressure without ripping or tearing. In conventional heat exchangers like that illustrated in FIG. 1, accommodating the design pressure and providing for the flow of the two fluids requires bulky manifold plates or frames.

Various embodiments include compact heat exchanger designs that eliminate the bulky manifold plates or frames common on plate-fin heat exchangers. In accordance with various embodiments, inlet and outlet ports may be integrated into each twin-foil assembly that forms a plate, replacing the bulky and costly prior art manifold structure with a smaller manifold ring that is a more cost-effective and thin design. The inlet and outlet ports of the smaller manifold rings may then be used to direct a fluid to flow through each plate.

Figure 2A:
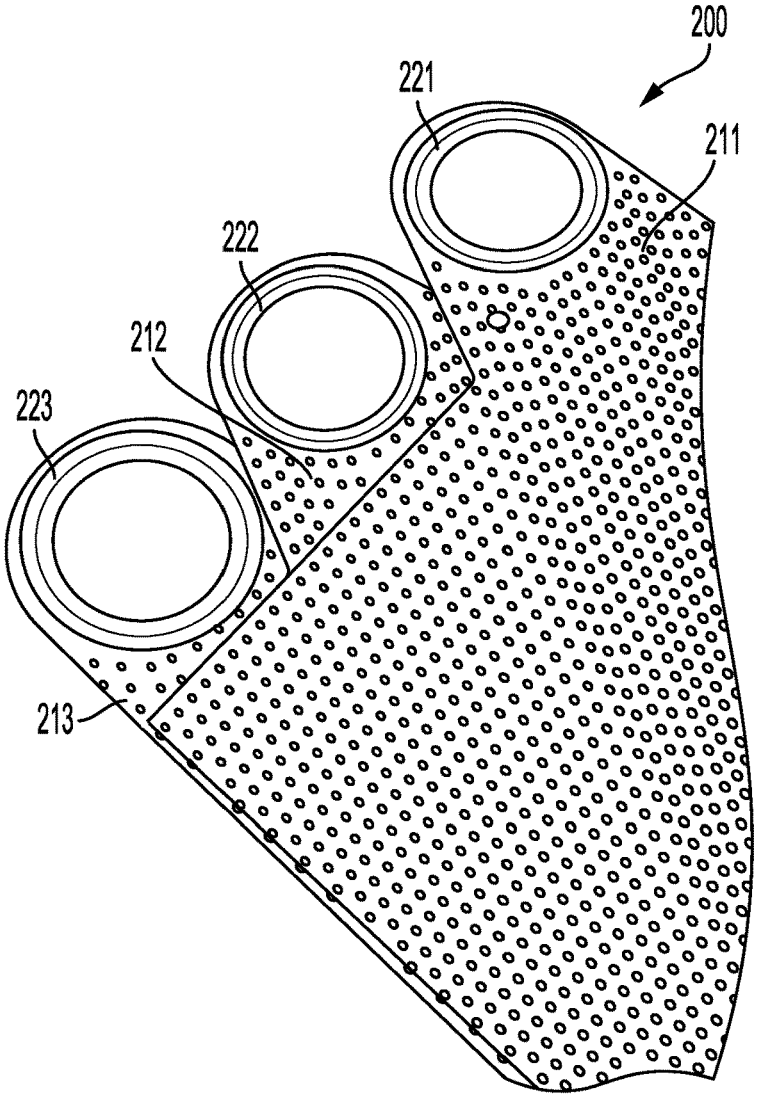
FIG. 2A is an isometric view of one end of three stacked and interlocking single-port manifold plates according to an embodiment.

FIG. 2A illustrates an ultra-compact heat exchanger in accordance with various embodiments. Embodiment heat exchangers include a series of stacked plates 200 made up of foil sheets. Pre-machined circular, or other custom shaped, inlet port rings 221, 222, 223 are welded onto the top and bottom surfaces of apertures extending through pairs of the foil sheets that form inlet ports in each plate. Similar apertures and port rings may be included to form outlet ports (not shown). These port rings act like manifolds that are attached to the foil plates eliminating the need for prior art axial manifolds described above. Such inlet port rings 221, 222, 223 may be located at the ends of heat exchanger, forming ports for the entry and exit of a first fluid.

In FIG. 2A, one end of three stacked plates 211, 212, 213 is shown, with each plate including a port ring 221, 222, 223. Each of the three stacked plates 211, 212, 213 may be formed by conduction-welding two thin metal sheets (i.e., foil sheets) at a series of spaced apart bonding locations across the planar extent thereof in a pattern. Each of the thin metal sheets may be between approximately 0.001-0.010 inches (0.025-0.25 mm) thick. In addition, a continuous conduction-weld may be applied to a perimeter of each of the three stacked plates 211, 212, 213 to form a seal-weld all around. The thin foil sheets forming each of the three stacked plates 211, 212, 213 may be made of titanium, aluminum, and/or other metals capable of holding shape in an ultra-thin foil form. Once two foil sheets are conduction-welded in the bonding locations and around the perimeter, pressure is introduced by a fluid (e.g., air or a liquid) between the foil sheets to balloon areas of foil between and around the bonded locations within the seal-welded perimeter. The ballooned areas of foil form a pillowed or quilted outer plate structure that maintains the ballooned shape after the internal pressure is no longer applied. The ballooned areas of foil form internal plate passages that will allow the first fluid to flow between the two foil sheets. In addition, two relatively large apertures may be formed, extending through the joined foil sheets, at two opposed ends thereof.

The port rings 221, 222, 223 may be secured into and/or onto each of the two large apertures to form inlet and outlet ports therein. In this way, the inside edges of the two large apertures may get sandwiched between an upper annular port disk and a lower annular port disk forming two halves of each port ring 221, 222, 223. In some embodiments upper and lower annular port disks may be metal, like titanium, which may be welded to the respective upper and lower surfaces of the respective plate 211, 212, 213. The port rings 221, 222, 223 providing inlet or outlet ports include radial gaps or openings in inner walls that allow fluid to flow into or out of the internal plate passages.

FIG. 2A shows an embodiment featuring three stacked plates 211, 212, 213 with the position of a central axis of the port rings 221, 222, 223 horizontally offset from one another. The port rings 221, 222, 223, may be as thick as 4 mm. If the port rings for each plate 211, 212, 213 were designed to be axially aligned, then the plate spacing may be limited by the thickness of the port rings. Offsetting or staggering the port rings 221, 222, 223 may reduce the spacing required between the three stacked plates 211, 212, 213.

The stacked plates 211, 212, 213 are configured and assembled to leave a gap or series of channels between the plates 211, 212, 213. The gap or channels allows a second fluid, such as refrigerants in vapor-cycle systems, water, or other liquids, to flow there through between the welded plates.

Figure 2B:
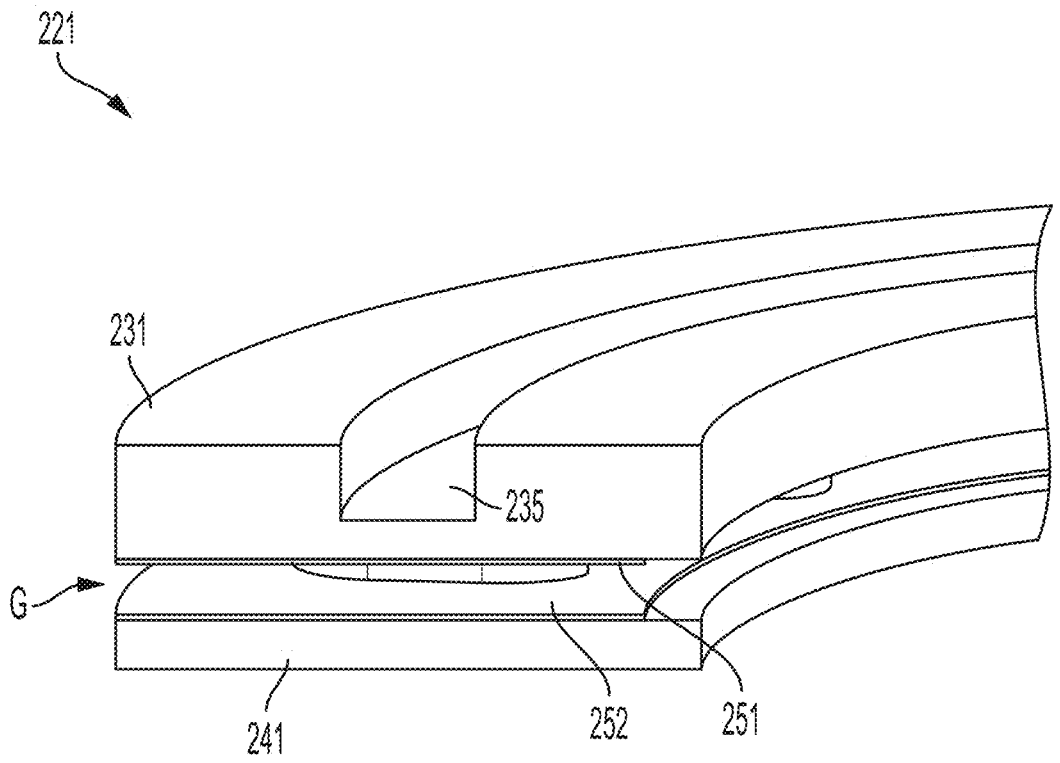
FIG. 2B is a cross-sectional isometric view of a portion of the port ring in the single-port manifold plate of FIG. 2A according to an embodiment.

FIG. 2B illustrates a cross-sectional view of a portion of the port ring 221 in the single-port manifold plate of FIG. 2A according to an embodiment. The port ring 221 may be formed by a top plate 231, which may include an O-ring groove 235. In contrast, a bottom plate 241 of the port ring 221 does not have such a groove. A small gap G is formed between the top plate 231 and the bottom plate 241 with a spacer to create a fluid flow gap there between. A foil sheet 251 (i.e., one of the pair of foil sheets to be bonded together) may be welded to the top plate 231. The combined structure of the foil sheet 251 welded to the top plate 231 is referred to as a "scroll piece." Similarly, another foil sheet 252 (i.e., the other one of the pair of foil sheets to be bonded together) may be welded to the bottom plate 241. The combined structure of the second foil sheet 252 welded to the bottom plate 241 is also referred to as a "scroll piece." In this way, one scroll piece has the top plate 231 with the O-ring groove 235 and the other scroll piece has the bottom plate 241.

Figure 3:
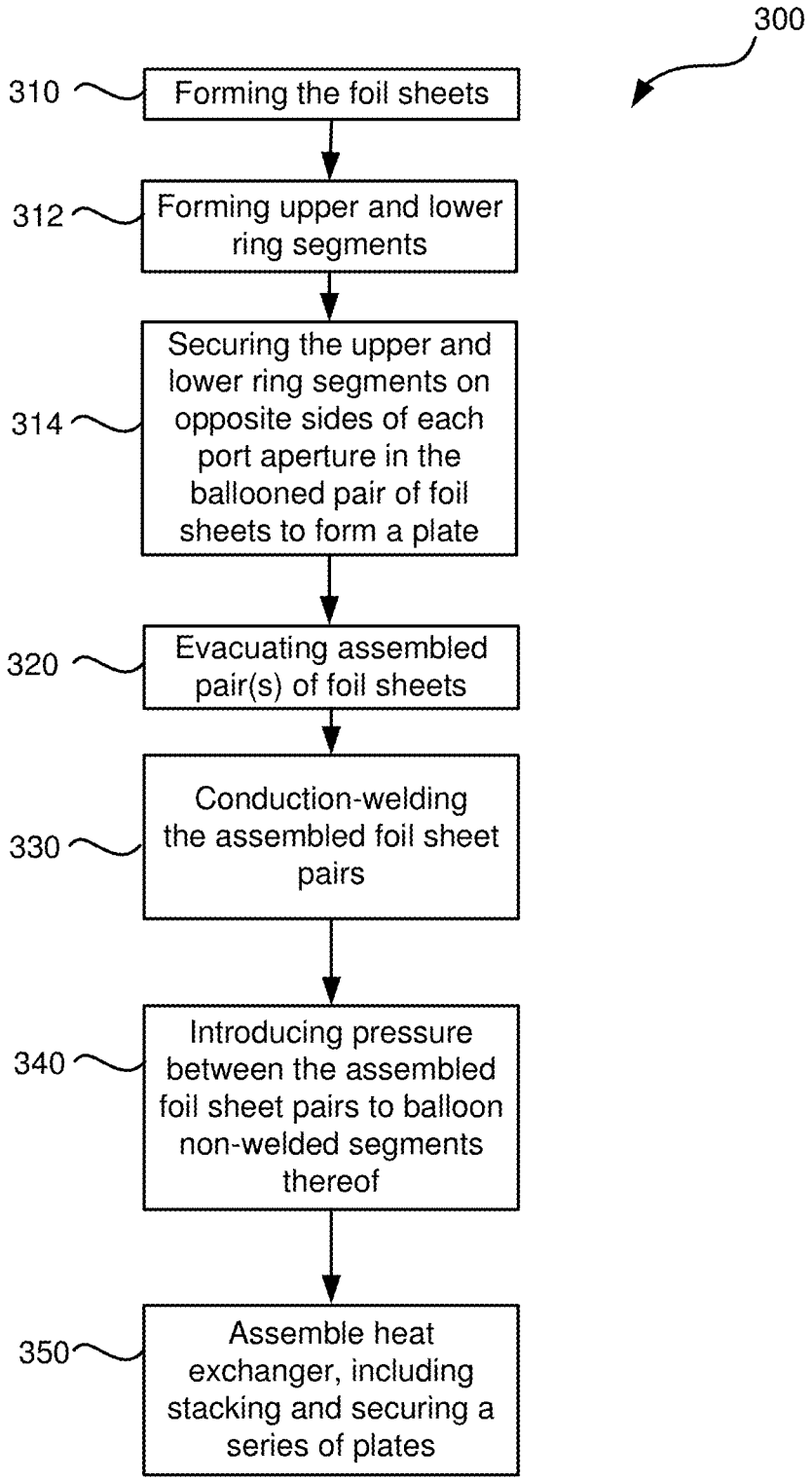
FIG. 3 is a process flow diagram of a method of making a heat exchanger with single-port manifold plates according to an embodiment.

FIG. 3 illustrates an embodiment method 300 of making a heat exchanger, which includes forming and using the series of stacked plates 200 described above with reference to FIG. 2A.

The method 300 may include forming ultra-thin sheets of foil in operation 310. In particular, foil sheets may be cut to size, having an appropriately shaped outer perimeter configured to fit within a heat exchanger housing. Alternatively, some or all of the cutting operations may be performed after conduction-welding operations (e.g., operation 330). In addition, port apertures may be cut at opposite ends of each of the foil sheets. The port apertures may be cut and configured to accommodate a port ring.

In operation 312, upper and lower annular ring segments may be formed. The upper and lower annular ring segments may form opposing halves of the port rings (e.g., 221, 222, 223) once joined.

In operation 314, the upper and lower annular ring segments may be secured to opposite sides of each of the port apertures formed in the ballooned pair of foil sheets. In this way, edges of the port apertures will be sandwiched between the upper and lower annular ring segments. The upper and lower annular ring segments may be welded to one another and/or welded to the foil sheets there between to form an individual plate. A series of plates may be formed in this way.

In operation 320, a matching pair of the ultra-thin sheets of foil may be laid against one another and aligned for conduction-welding in operation 330. In addition, the matched pair of ultra-thin sheets of foil may be evacuated to ensure good contact of the internal space there between.

In operation 330, the matched and aligned (i.e., assembled) pair of foil sheets may be conduction-welded together. In particular, the assembled pair of foil sheets may be conduction-welded at a series of spaced apart bonding locations across a planar extent of the two foil sheets in a pattern. Each of the series of spaced apart bonding locations on the foil sheets may be conduction-welded in a small generally circular area. In addition, the two foil sheets may be seal-welded to form a continuous perimeter seal. In addition, a continuous perimeter seal may be applied to the perimeter of the two foil sheets by conduction-welding around the perimeter. Alternatively, the continuous perimeter seal, or a portion thereof, may be applied to an inner region of the two foil sheets (i.e., not on the perimeter) in one stage. In this way, a weld-path of conduction-welding traces a continuous line that will eventually form the perimeter. In a second stage, the excess foil outside the perimeter seal may be cut away (i.e., trimmed). By trimming away excess foil beyond the seal-weld (i.e., the conduction-welded weld-path), the seal-weld may eventually be disposed along a perimeter of the bonded pair of foil sheets. In this way, as little excess material as possible may remain outside the perimeter seal. Also, since the weld-path may be applied in almost any shape (e.g., within the field of view of a laser), the final perimeter shape of the bonded pair of foil sheets, as well as multiple sets of stacked pairs of foil sheets, may be formed into almost any desired shape. This capability may provide additional advantages as heat exchangers of any shape may be formed from square or rectangular foils, which may be assembled using standard tooling, thereby avoiding the need for special tooling to make heat exchangers of a variety of different shapes.

This conduction-welding process may be performed in a vacuum and may be performed in the presence of an inert gas. Unlike the epoxy bonded fins of the prior art, various embodiments employ conductive welding techniques that may reliably bond ultra-thin foils (e.g., between ~0.001" and ~0.004" thick, ±0.0005") without key-hole welds or opaque inserts to limit the penetration of laser energy. Foil thickness may be constrained by the operating pressure of the heat exchanger, material strength, and the size of the internal plate passages configured to allow the flow of fluid between the two foil sheets, and may be adjusted based on the heat exchanger's end use. Also, the pattern and number of bonding locations may be determined based upon the design pressure for the heat exchanger.

In some embodiments, the conduction-welding is performed using a laser oriented facing the planar surface of a top one of the two thin metal sheets stacked and held together under vacuum conditions. The laser may be moveable in three dimensions (x, y-axis extending perpendicular to one another across the planar surface and a z-axis toward and away from the planar surface) with a 5-micrometer accuracy. Optionally, the laser for performing welds may be an optical-controlled/guided laser (e.g., using galvo-mirrors). The laser may be configured to apply radiation to and thus heat a small area in the top sheet, just enough to slightly melt that material and fuse the top metal sheet to the bottom metal sheet. Neither sheet needs to be heated enough to form a key-hole weld, which substantially mixes the metals of the adjoining sheets. The amount and duration of heat applied by the conduction-welding process may vary to suit the particular type and thickness of metal foil.

In operation 340, pressure may be introduced between the two foil sheets to expand the individual plates. While the bonded locations hold, the areas of foil between and around the bonded locations yield from the pressure and balloon, separating the two thin metal sheets from one another between the bonded locations. The yielded thin metal sheets hold their ballooned shape after the pressure is no longer applied, resulting in a pillow-like shape or quilted form in each plate.

In operation 350, a heat exchanger may be assembled by stacking and securing together a series of the plates leaving a volume between the plates for passage of the second fluid. The first plate in the stack may be a header-plate, which may be slightly different since it is configured not to be sandwiched between two other plates. Similarly, the last plate in the stack may be a follower plate, which may also be different since it is configured not to be sandwiched between two other plates. The plates may be secured by welding, with or without spacers and a perimeter-seal gasket there between. The series of stacked plates may be used in a heat exchanger housing that will contain the second fluid. When stacking multiple plates into a heat exchanger housing, the perimeter-seal gasket may not be necessary.

Figure 4A:
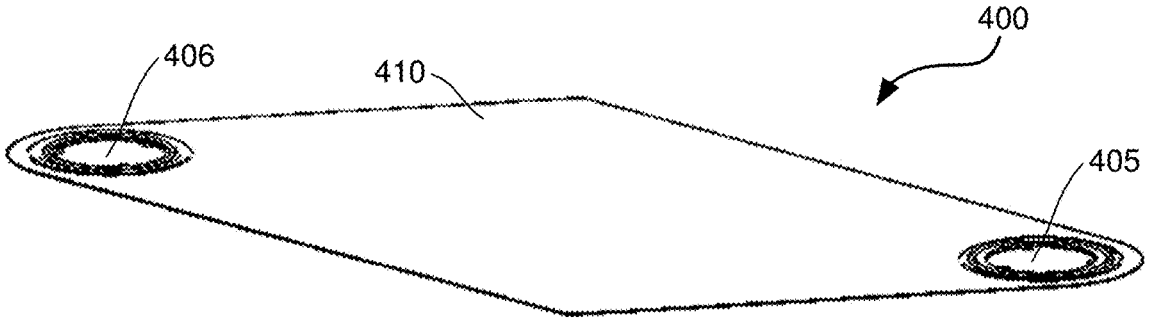
FIG. 4A is an isometric view of a foil-formed manifold plate according to an embodiment.
Figure 4B:
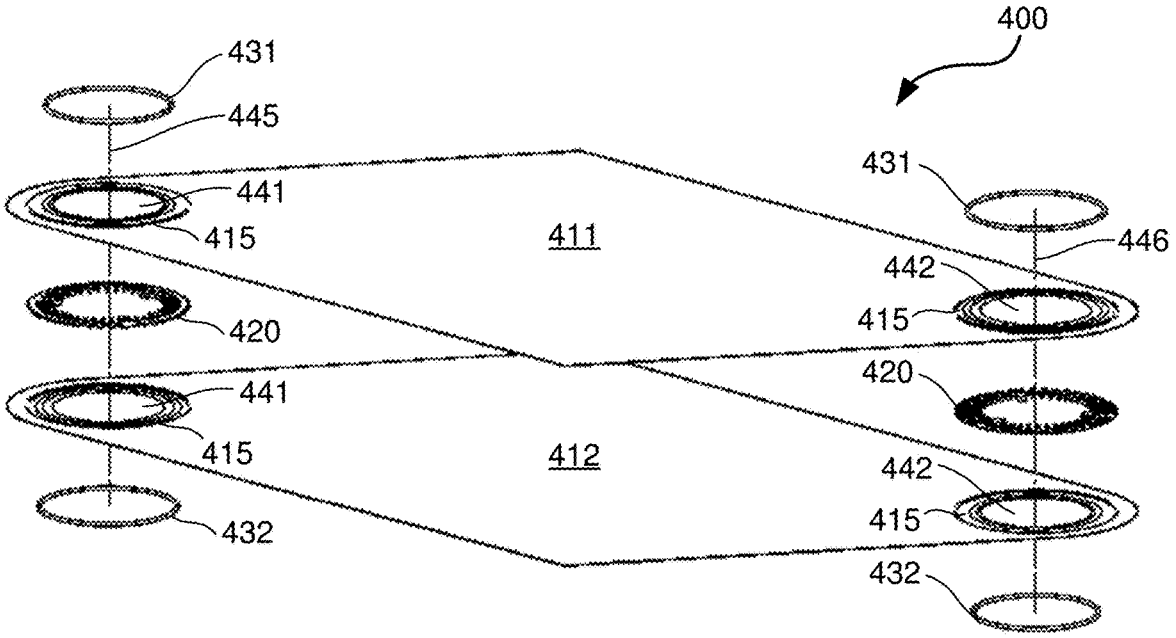
FIG. 4B is an exploded isometric view of the foil-formed manifold plate of FIG. 4A.

FIGS. 4A and 4B illustrate a formed foil plate assembly 400 of a heat-exchanger in accordance with various alternative embodiments. FIG. 4A shows a finished plate assembly 400, while FIG. 4B shows an exploded view of the plate assembly 400 in FIG. 4A.

In accordance with various embodiments, foil-formed manifolds may function hydraulically similar to the "single port manifolds," but remove the necessity for any thick, machined manifold plate components. The foil-formed manifolds may use a 3D printed, or otherwise formed, spacer which fits between the two foil sheets prior to welding, and creates both a spacer during welding process and a compressive strength member once the plates are stacked. The foils are pre-formed in this region using low-cost stamping methods in order to fit properly on the spacers, and have a pre-formed groove for a grooved-gasket type seal between the plates. During the welding and expansion process this design removes any welding or placement of the manifold plates described in the above designs. During the stacking process, where the plates are stacked to form a heat exchanger, these spacers also act to provide compressive strength in order to keep the manifold inlet/outlet flow conduits open.

The plate assembly 400 may include two internal spacers 420, one secured in the inlet port 405 at one end of the plate 410 and another secured in the outlet port 406 at the opposite end of the plate 410. A central axis 445, 446 of each of the inlet and outlet ports 405, 406 extends through the two foil sheets 411, 412 perpendicular to a planar extent of the two foil sheets 411, 412. In accordance with various embodiments, the inlet and outlet ports 405, 406 may be offset from an outer perimeter of the two foil sheets 411, 412. The offset and/or the actual position of the inlet and outlet ports 405, 406 may be designed for the particular heat-exchanger application.

The internal spacer is sandwiched between the two foil sheets 411, 412. In particular, the edges of apertures 441, 442 formed at the opposed ends of each foil sheet 411, 412 may sandwich and secure each internal spacer 420. Unlike the port rings (e.g., 221, 222, 223 in FIG. 2A) of the stacked single-port manifold plates, which get secured after the conduction-welding process (i.e., operation 330), the internal spacers 420 may be held between the two foil sheets 411, 412 prior to the conduction-welding process. Each internal spacer 420 not only maintains space (i.e., resisting compression) between at least the ends of the two foil sheets 411, 412, but also keeps the ends of internal plate passages in the two foil sheets 411, 412 open for fluid to flow there through. In this way, the internal spacer 420 ensures that fluid flowing into the inlet port 405 may pass through the internal plate passages of the plate 410 and out the outlet port 406.

With the internal spacers 420 between the two foil sheets 411, 412, the air between the sheets is evacuated to press the sheets firmly together, and then the laser conduction-welding process described above is performed to create the pattern of bonding locations. Once the bonding locations are formed, pressure is introduced between the foil sheets 411, 412 via the spacers to expand the foils to form the pillow-like form described above with reference to FIG. 2A.

The plate assembly 400 may also include upper gaskets 431 applied on the top side of the top foil sheet 411 and a lower gasket 432 applied on the lower side of the lower foil sheet 412. In fact, each of the two foil sheets 411, 412 may be pre-formed with grooves 415 configured to receive and hold the upper and lower gaskets 431, 432, which may provide a seal between the two foil sheets 411, 412 and each internal spacer 420, as well as between adjoining plate assemblies 400. The upper gasket 431 is illustrated as having a smaller diameter than the lower gasket 432. This avoids interference between the upper gasket 431 and a lower gasket (e.g., 432) of a second plate (e.g., 410) stacked on top of the plate 410 illustrated. Similarly, in this way interference is avoided between the lower gasket 432 and an upper gasket (e.g., 431) of a third plate (e.g., 410) stacked below the plate 410 as illustrated. Alternatively, the upper gasket 431 may have a larger diameter than the lower gasket 432.

Using the internal spacer 420 may reduce the overall plate thickness, as compared to using the thick ring segments forming the port rings of the single-port manifold plate design described above with reference to FIG. 2A. In this way, the plates 400 having the internal spacers 420 may be approximately 0.2-2.0 mm thick, even at the inlet and outlet ports 405, 406, which may be thin enough to avoid the need to horizontally stagger or offset the position of the inlet and outlet ports 405, 406. If desired, separate plates 400 may be formed to have offset inlet and outlet ports 405, 406 from one another, similar to that for the plate 200 shown in FIG. 2A.

Figure 5A:
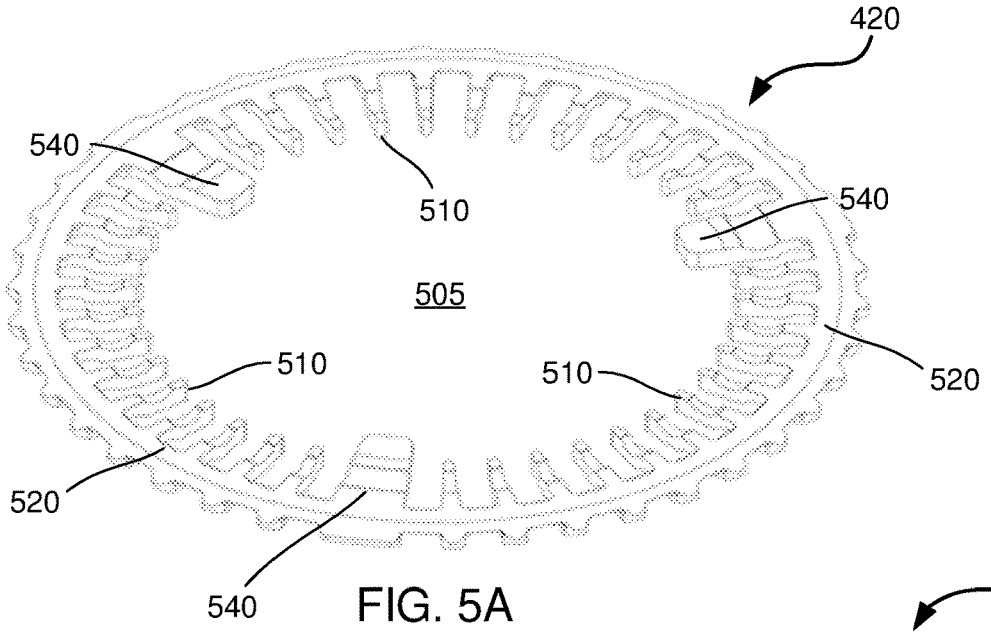
FIG. 5A is an isometric view of an internal spacer for foil-formed manifold plates according to an embodiment.
Figure 5B:
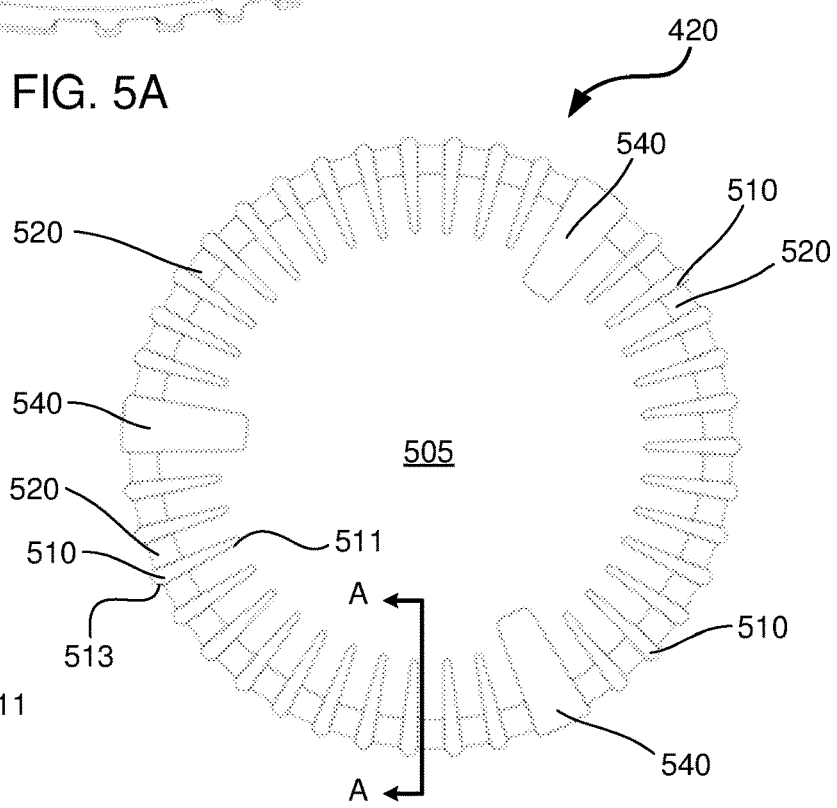
FIG. 5B is a top view of the internal spacer of FIG. 5A.
Figure 5C:
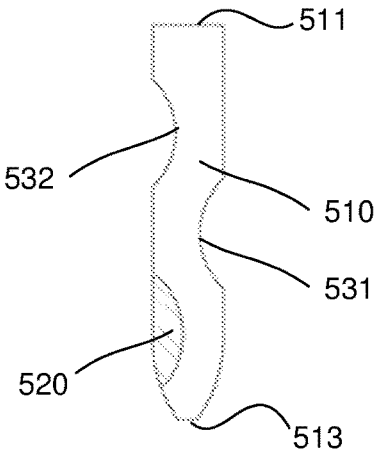
FIG. 5C is a section view at A-A in FIG. 5B showing an internal spacer tooth.
Figure 5D:
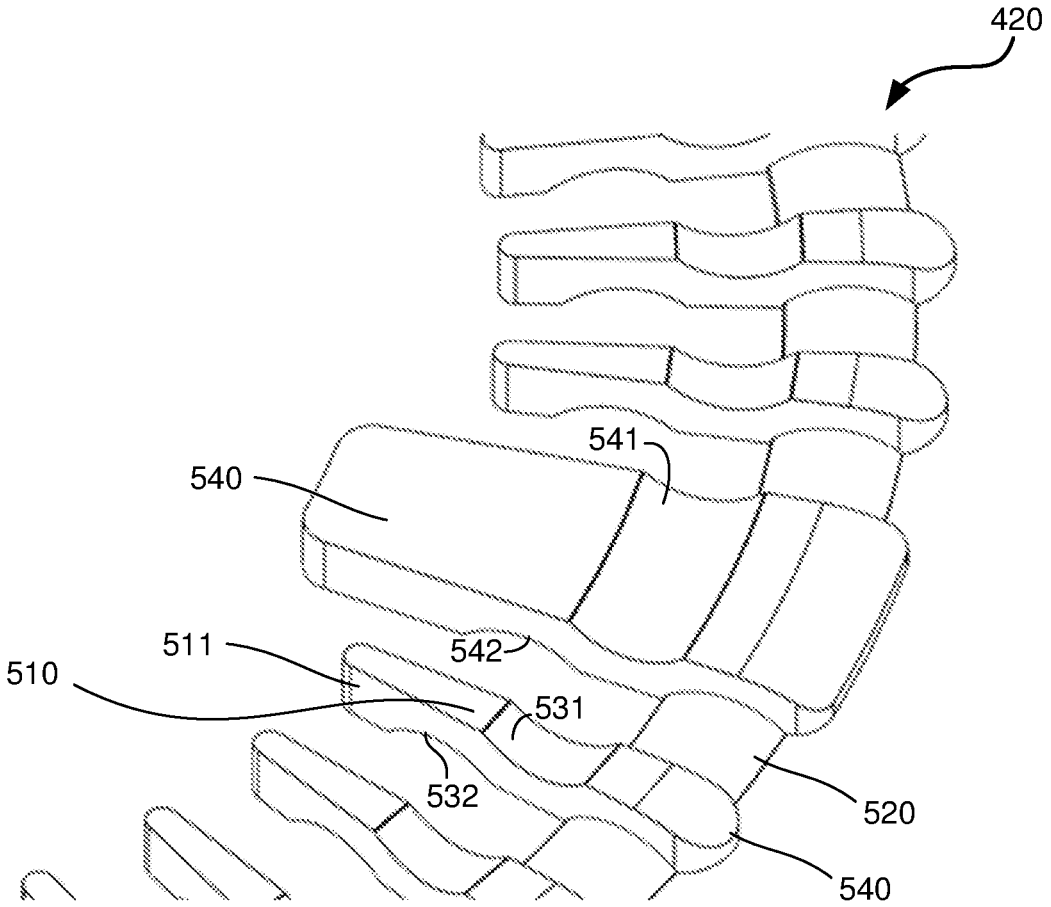
FIG. 5D is a close-up relief view of the internal spacer of FIG. 5A according to an embodiment.

FIGS. 5A-5C illustrate details of the internal spacers 420 for a single port axial manifold plate assembly heat-exchanger in accordance with various alternative embodiments. FIG. 5A shows an isometric view of the internal spacer 420. FIG. 5B shows a top view of the internal spacer 420 in FIG. 5A. FIG. 5C illustrates a section view at A-A in FIG. 5B, illustrating one of the radial teeth 510 of the internal spacer 420. FIG. 5D illustrates a close-up relief view of the internal spacer of FIG. 5A according to an embodiment.

In various embodiments, the internal spacer 420 may be formed with a connecting ring 520 having an inner diameter that is bigger than an inner diameter of the apertures (e.g., 441, 442 in FIG. 4B) formed at the opposed ends of each foil sheets (e.g., 411, 412).

The internal spacer 420 may support numerous radial teeth 510 that project radially inward from the connecting ring 520, leaving an inner aperture 505 open. Thus, each radial tooth 510 includes a radially inner end 511 and a radially outer end 513. The spacing around the internal spacer 420 of the radial teeth 510, as well as the relative size of the radial teeth relative to the connecting ring, allows fluid to flow between the radial teeth 510 and over or under the connecting ring 520. In this way, the internal spacers 420, which are located at the inlet and outlet ports (e.g., 405, 406 in FIG. 4A), and particularly the radial teeth 510, facilitate fluid to flow between the two foil sheets (e.g., 411, 412 in FIG. 4B).

The radial teeth 510 may all be interconnected and integrally formed with the connecting ring 520. In addition, the radial teeth 510 may include a radially outer curved groove 531 formed on one side (e.g., the top side) of the internal spacer 420 and a radially inner curved groove 532 formed on the opposite side (e.g., the bottom side) of the internal spacer 420. The radially outer and inner curved grooves 531, 532 may be sized and shaped to conform to the grooves (e.g., 415) surrounding the apertures (e.g., 441, 442) that may be stamped into the foil sheets (e.g., 411, 412). Once the internal spacer 420 is sandwiched between the foil sheets, sitting in the grooves surrounding the apertures, the radially outer and inner curved grooves 531, 532 may hold the internal spacer 420 in-place without needing adhesive, welding, or other bonding techniques. Thus, a circular internal spacer 420, sandwiched between the two sheets having annular grooves (e.g., 415), may rotate around the central axis 445, 446 of the two foil sheets 411, 412, but will otherwise be held in-place relative to the foil sheets 411, 412.

The internal spacer 420 may additionally support one or more large teeth 540. Like the radial teeth 510, the large teeth may project radially inward from the internal spacer 420 and may be integrally formed there with. Also, the large teeth 540 may work similar to the radial teeth, enabling fluid to flow between the two foil sheets. The large teeth 540 may include a radially outer curved groove 541 formed on one side of the internal spacer 420 and a radially inner curved groove 542 formed on the opposite side of the internal spacer 420, as shown in FIG. 5D. In addition, the large teeth 540 may be used as indexing keys for properly aligning, rotationally and/or positionally (i.e., orientationally), the internal spacers 420 relative to the foil sheets it is sandwiched between. Additionally, the size of the large teeth 540, which are larger than the radial teeth 510 and the connecting ring 520, may facilitate injection molding techniques that are aided by portions of a fabricated part with a larger thickness.

Alternatively, rather than being formed with radial teeth 510, the internal spacer 420 may be formed as a ring with conduits/holes around its perimeter. Such conduits/holes may enable fluid to flow between the two foil sheets (e.g., 411, 412 in FIG. 4B).

The internal spacer 420 may be formed of various materials, such as plastic, metal, etc. The material forming the internal spacer may be almost any material, provided that material is compatible with the internal fluid and strong enough to handle the compressive forces that occur during operation. For example, the material may be Polyphenylene sulfide (PPS), specifically the brand Ryton® (Solvay, Brussels, Belgium), which has shown good chemical compatibility with Anhydrous Ammonia ($NH_3$). Alternatively, the internal spacer 420 may be formed of metal, which may be structurally more reliable and may have application in mission critical systems and/or have reasonable costs at high volumes. For example, the internal spacer 420 may be formed of the same material as the foil sheets 411, 412. The internal spacer 420 may be formed as a machined plate or ring, which may be substantially thicker than the thin foil sheets 411, 412.

Figure 6A:
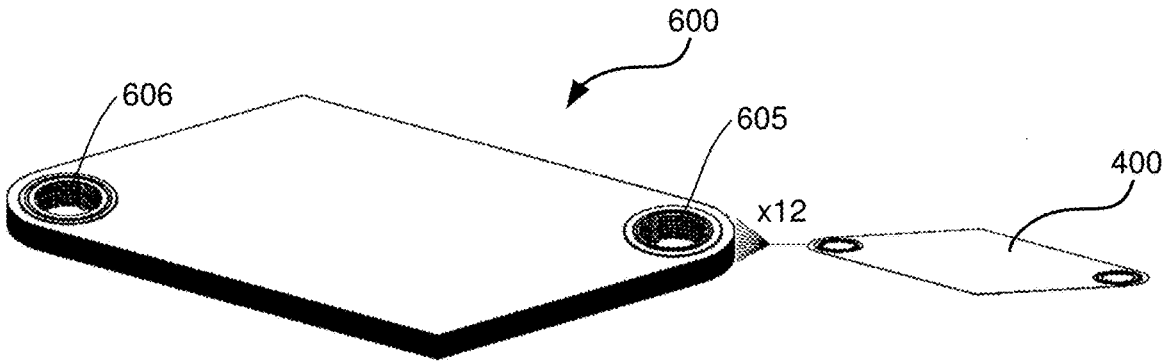
FIG. 6A is an isometric view of a stacked series of foil-formed manifold plates next to one separate single port axial manifold plate according to an embodiment.
Figure 6B:
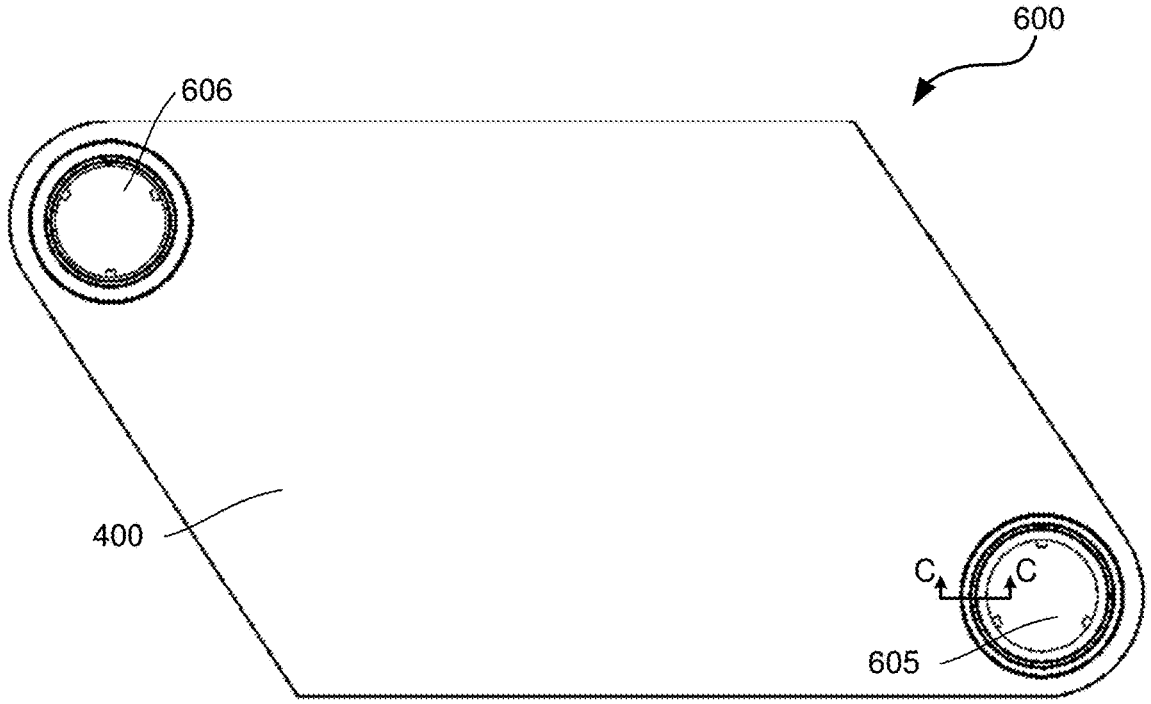
FIG. 6B is a top view of the stacked series of foil-formed manifold plates in FIG. 6A.
Figure 6C:
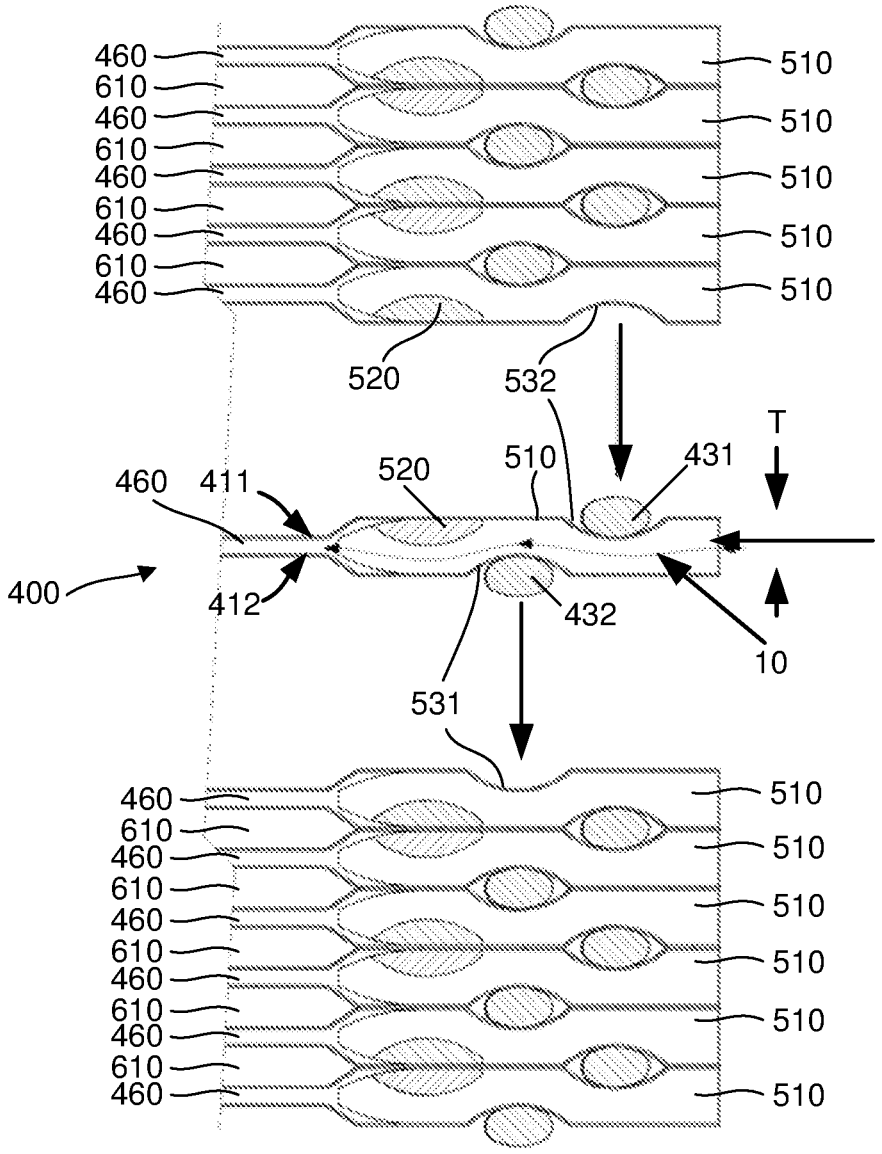
FIG. 6C is a section view at C-C in FIG. 6B showing a partially exploded cross-section of an outlet port formed by stacked plates in accordance with an embodiment.

FIGS. 6A-6C illustrate a stacked series 600 of single port axial manifold plates, in accordance with various embodiments. In particular, the stacked series 600 is formed by twelve (12) stacked single port axial manifold plates 400. The stacked series 600 may include combined inlet and outlet ports 605, 606 formed by the axial alignment of the respective inlet and outlet ports (e.g., 405, 406 in FIG. 4A) of the individual plates (e.g., 400).

FIG. 6C illustrates a partially exploded cross-section of the combined outlet port 606 in FIG. 6B, in accordance with an embodiment. In particular, FIG. 6C isolates one side of one inlet port (e.g., 405 in FIG. 4A) in a plate assembly 400 separated from other stacked plate assemblies above and below it. As shown, the isolated plate assembly 400 includes portions of two foil sheets 411, 412 sandwiching the internal spacer 420, including a radial tooth 510 and the connecting ring 520. In addition, the upper gasket 431 is seated in the radially inner curved groove 532 of the radial tooth 510, while the lower gasket 432 is seated in the radially outer curved groove 531 of the radial tooth 510. The internal spacers 420 may alternate with one internal spacer 420 having the radially inner curved groove 532 facing upward and the adjoining internal spacer 420 have the radially inner curved groove 532 facing downward. In this way, the upper gasket 431 may sit between two opposed inner curved grooves 532 that face one another. Similarly, the radially outer curved groove 531 of one internal spacer 420 may face the radially outer curved groove 531 of the adjoining internal spacer 420, so that the lower gasket 432 may sit there between.

An internal plate passage 460 is shown between the two foil sheets 411, 412. The internal plate passage 460 is configured to allow the flow of a first fluid therein. Thus, fluid entering the inlet port (e.g., 405 in FIG. 4A) may flow 10 between two radial teeth 510, under one gasket (e.g., the upper gasket 431), over another gasket (e.g., the lower gasket 432), under or over the connecting ring 520, and into the internal plate passage 460. In accordance with various embodiments, by using ultra thin foil, an outer thickness of the two foil sheets 411, 412 with the internal spacer there between may be between 0.2-2.0 millimeters thick T.

Also shown in FIG. 6C, the interstitial channels 610 are included, which allow a second fluid to flow therein and remain separated from the first fluid.

Figure 6D:
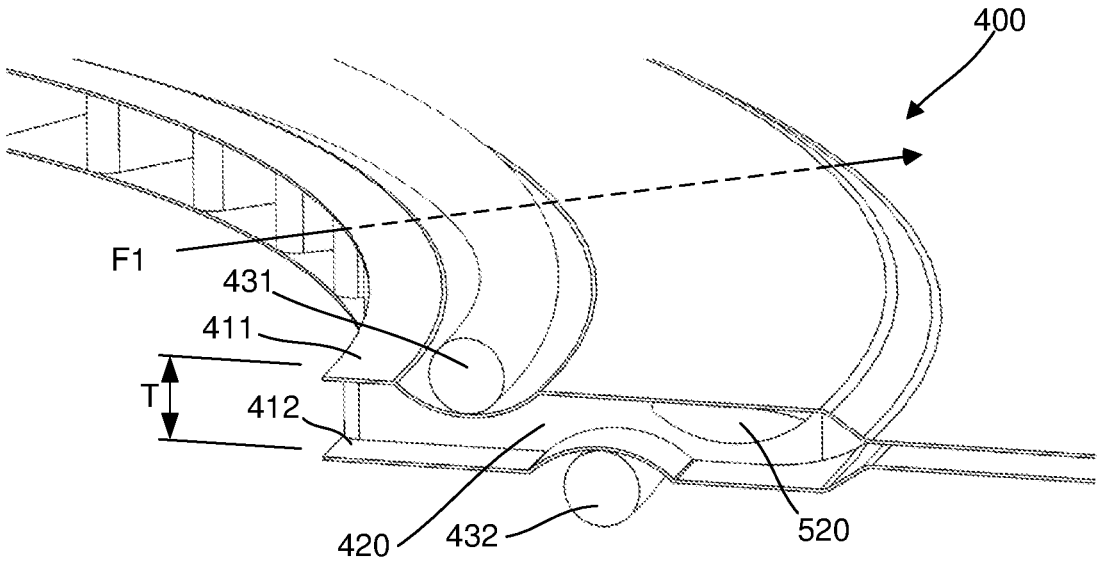
FIG. 6D is a cross-sectional isometric view of a portion of a foil-formed manifold plate with upper and lower O-rings, with an upper foil sheet shown as transparent in accordance with an embodiment.

FIG. 6D illustrates a cross-sectional isometric view of a portion of a foil-formed manifold plate 400 with the upper gasket 431 and the lower gasket 432. The upper foil sheet 411 is shown as transparent to demonstrate the relationship of the foil sheets 411, 412 and the internal spacer 420. A first fluid F1 flow path is illustrated between two of the teeth 510. However, it should be understood that the first fluid F1 may similarly flow between all the teeth 510.

Figure 6E:
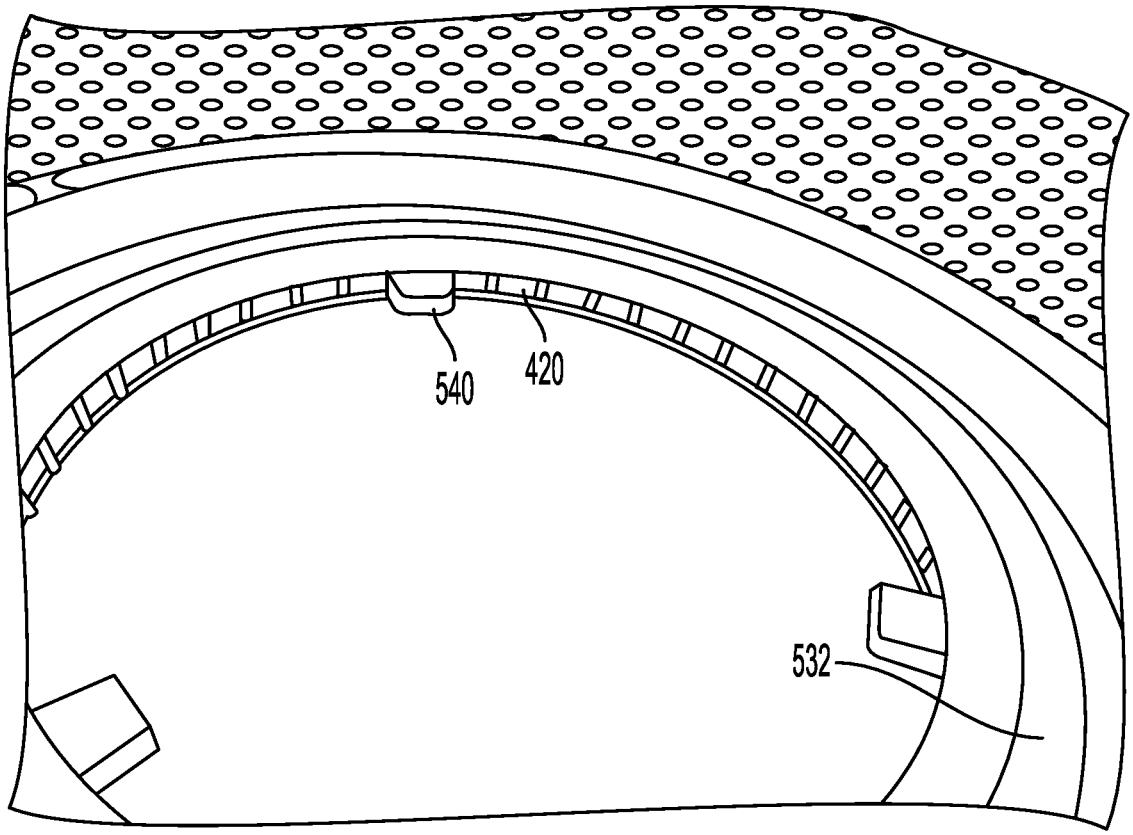
FIG. 6E is an isometric view showing an inlet port formed by a pair of thin-foil sheets with an internal spacer there between in accordance with an embodiment.

FIG. 6E illustrates an isometric view of an inlet port (e.g., 405 in FIG. 4A) formed by a pair of thin-foil sheets (e.g., 411, 412) with an internal spacer there between in accordance with an embodiment. Also shown is the radially inner curved groove 532 configured to receive an O-ring.

Figure 7:
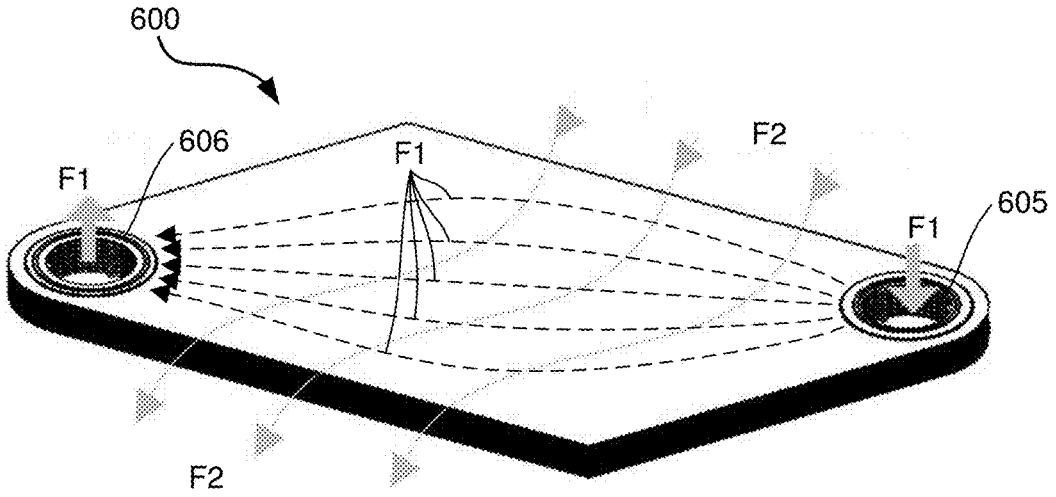
FIG. 7 is an isometric view of the stacked series of foil-formed manifold plates from FIG. 6A showing fluid flow lines for two different fluids according to an embodiment.

FIG. 7 illustrates the flow of two different fluids through a stacked series of single port axial manifold plates, in accordance with various embodiments. A first fluid F1 is shown flowing into the combined inlet port 605, through the internal plate passages (e.g., 460 in FIG. 6C), and out of the combined outlet port 606. In contrast, a second fluid F2 is shown flowing across the stacked series of plates 600 through the interstitial channels 610.

Figure 8:
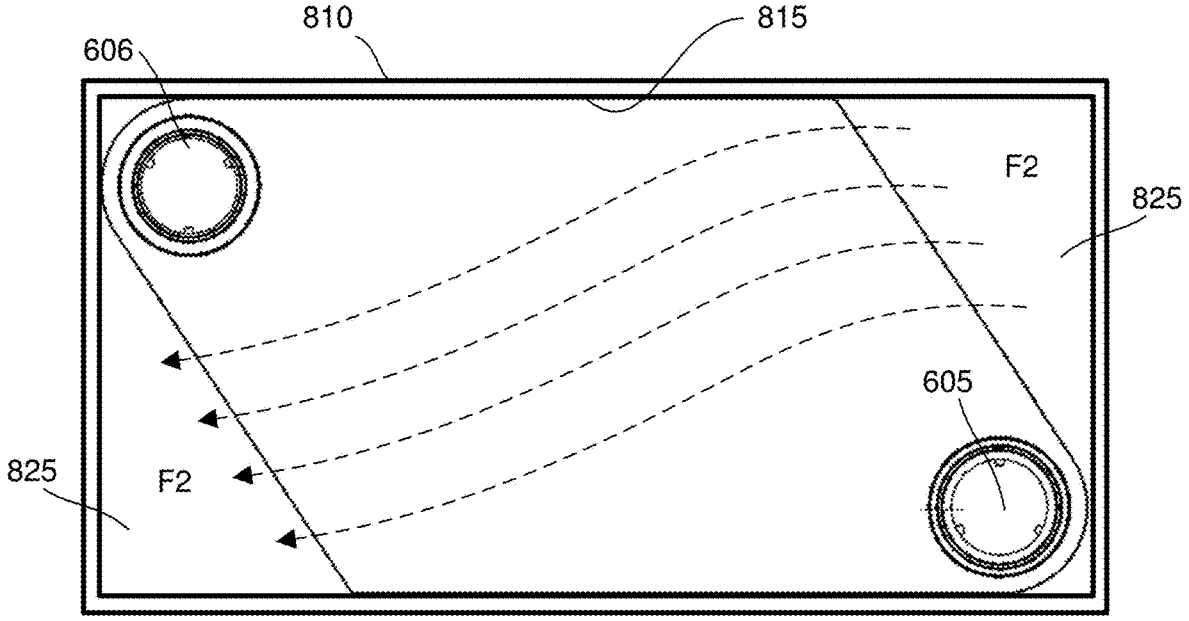
FIG. 8 is a top view of the stacked series of foil-formed manifold plates from FIGS. 6A and 7 within a heat exchanger housing according to an embodiment.

FIG. 8 illustrates the stacked series 600 of single port axial manifold plates loaded into a rectangular heat exchanger housing 810. The stacked series 600, which is generally shaped like a parallelogram, may be sized to fit snuggly within the inner walls 815 of the heat exchanger housing 810, which may be generally shaped like a rectangle. Due to the difference in shape between the stacked series 600 and the inner walls 815, two open regions 825 are left open within the heat exchanger housing 810. The open regions 825 may be filled with the second fluid F2, which is made to circulate within the heat exchanger housing 810 and through the interstitial channels (e.g., 610) between the stacked plates.

Figure 9:
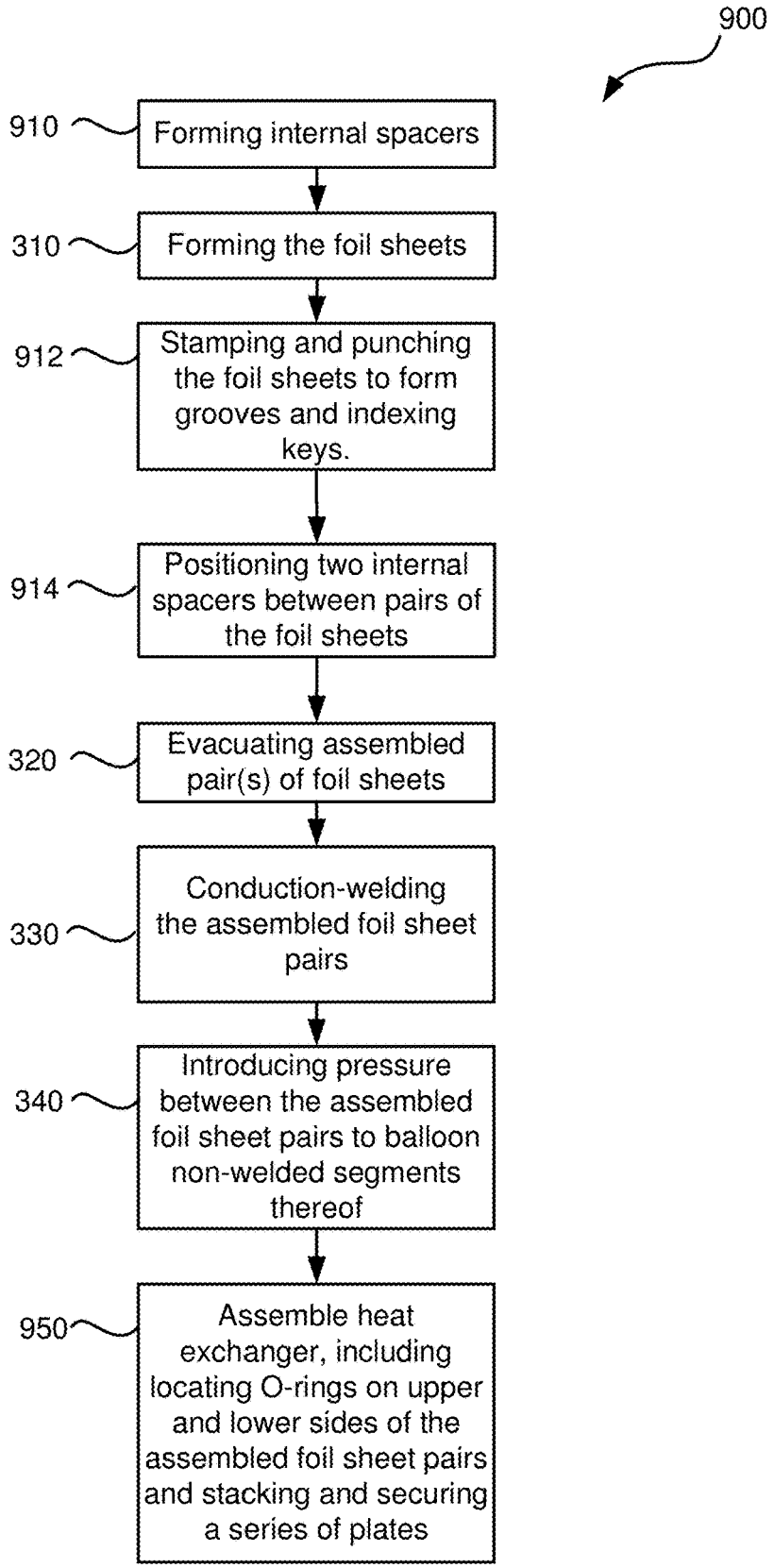
FIG. 9 is a process flow diagram of a method of making a heat exchanger with stacked foil-formed manifold plates according to an embodiment.

FIG. 9 illustrates an embodiment method 900 of making a heat exchanger, which includes forming a series of single port axial manifold plate assemblies, as described above with reference to FIGS. 4A-8. In the method 900, the heat exchanger may be made by performing operations 310, 320, 330, and 340 of the method 300, as described above.

In operation 910, internal spacers are formed (e.g., e.g., 420 in FIG. 4B). Alternatively, the operation in operation 910 may follow operation 310.

Between operations 310 and 320 of the method 300 described above, in operation 912, the foil sheets may be stamped to form grooves for the internal spacer (e.g., 420 in FIG. 4B) and the upper and lower gaskets (e.g., 431, 432 in FIG. 4B). Also as part of operation 912, the foil sheets may be punched to form indexing keys for properly orienting the internal spacer.

Between operations 310 and 320 (i.e., prior to assembling and evacuating each pair of foil sheets), in operation 914 two internal spacers may be positioned between a pair of the foil sheets, around the formed port apertures, in the grooves formed in operation 912.

In operation 950, a heat exchanger may be assembled by stacking and securing together a series of plates. Initially, a header plate may be placed to start the stack. Thereafter, O-rings (e.g., larger diameter O-rings) may be located (and optionally secured) on the upper surface of the inlet and outlet ports and a seal gasket may be placed around a perimeter of the header plate. One of the assembled foil sheet pairs may then be stacked on top of the header plate, with the O-ring groove therein being aligned with the O-rings placed on the header plate. Another pair of O-rings (e.g., smaller diameter O-rings) may be located (and optionally secured) on the upper surface of the inlet and outlet ports and a seal gasket may be placed around a perimeter of the stacked foil sheet pair. Thereafter, the process may repeat, locating O-rings on the upper surface of the inlet and outlet ports of the previously stacked foil sheet pair, locating a sealing gasket, stacking the next assembled foil sheet pair, and locating O-rings on the upper surface of the inlet and outlet ports and another seal gasket on that last stacked foil sheet pair. The stack may be completed by placing the follower plate as the last plate on the top of the stack.

Figure 10:
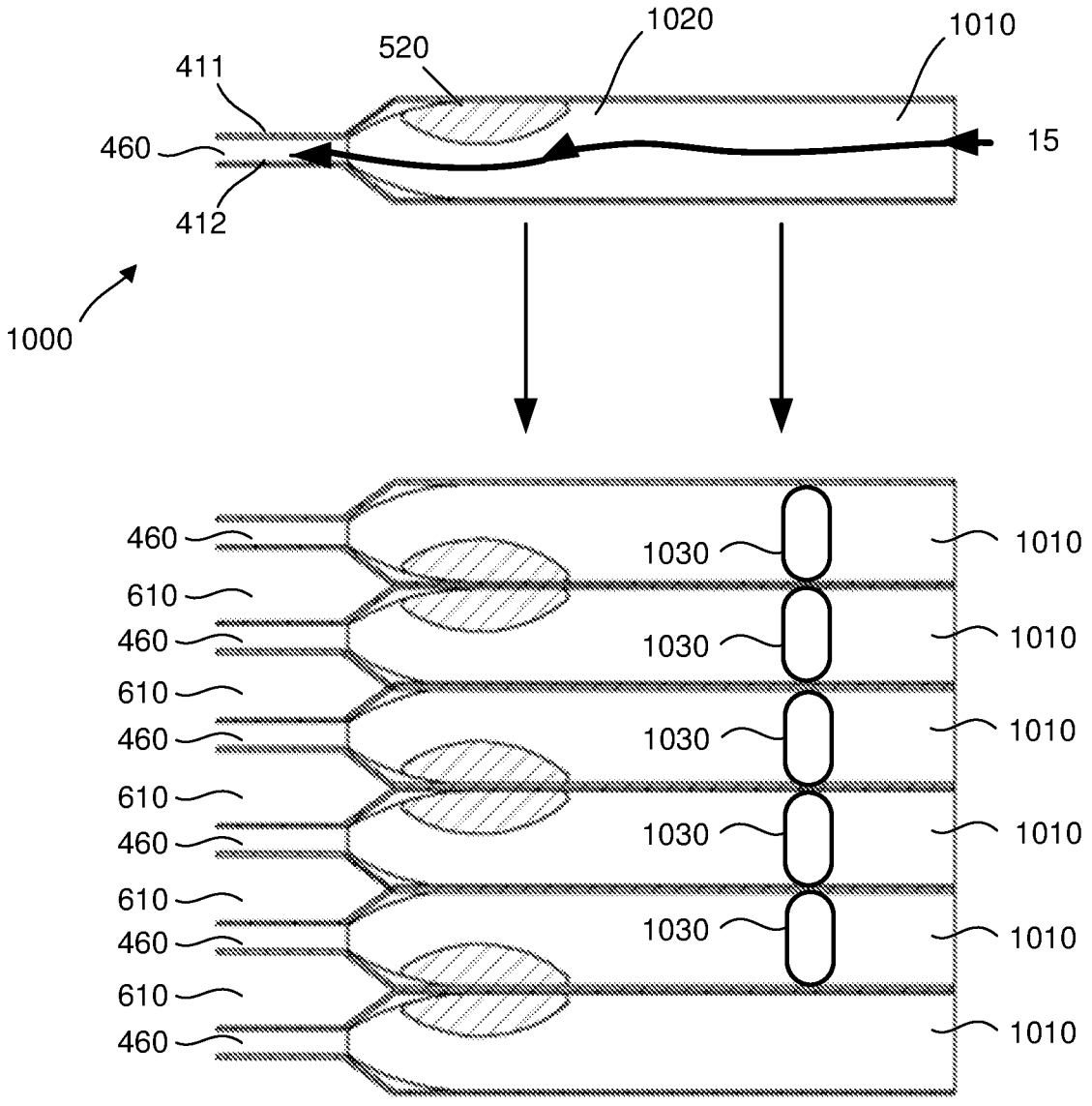
FIG. 10 is a section view showing a partially assembled cross-section of an outlet port formed by stacked alternative foil-formed manifold plates without O-rings in accordance with an embodiment.

FIG. 10 illustrates a section view of a partially assembled cross-section of an outlet port formed by alternative-embodiment stacked foil-formed manifold plates without O-rings, in accordance with another embodiment. FIG. 10 is a similar section view to that of FIG. 6C, but for alternate plate assemblies 1000 that do not need O-rings between for sealing and spacing. As shown from the perspective of one side of one inlet port, each plate assembly 1000 may be stacked atop another and seal-welded thereto at a welding location 1030 that will ensure a bond and seal between adjacent plate assemblies.

As shown, the isolated plate assembly 1000 includes portions of two foil sheets 411, 412 sandwiching an alternative internal spacer 1020, including a radial tooth 1010 and the connecting ring 520. Since the plate assembly 1000 does not use O-rings (i.e., gaskets), the radial tooth 1010 need not include curved surface grooves for them.

The internal plate passage 460 is shown between the two foil sheets 411, 412. The internal plate passage 460 is configured to allow the flow of a first fluid therein. Thus, fluid 15 entering the inlet port may flow between two radial teeth 1010, under or over the connecting ring 520 and into the internal plate passage 460. As with the embodiments described above, the interstitial channels 610 are included, which allow a second fluid to flow therein and remain separated from the first fluid.

Figure 11:
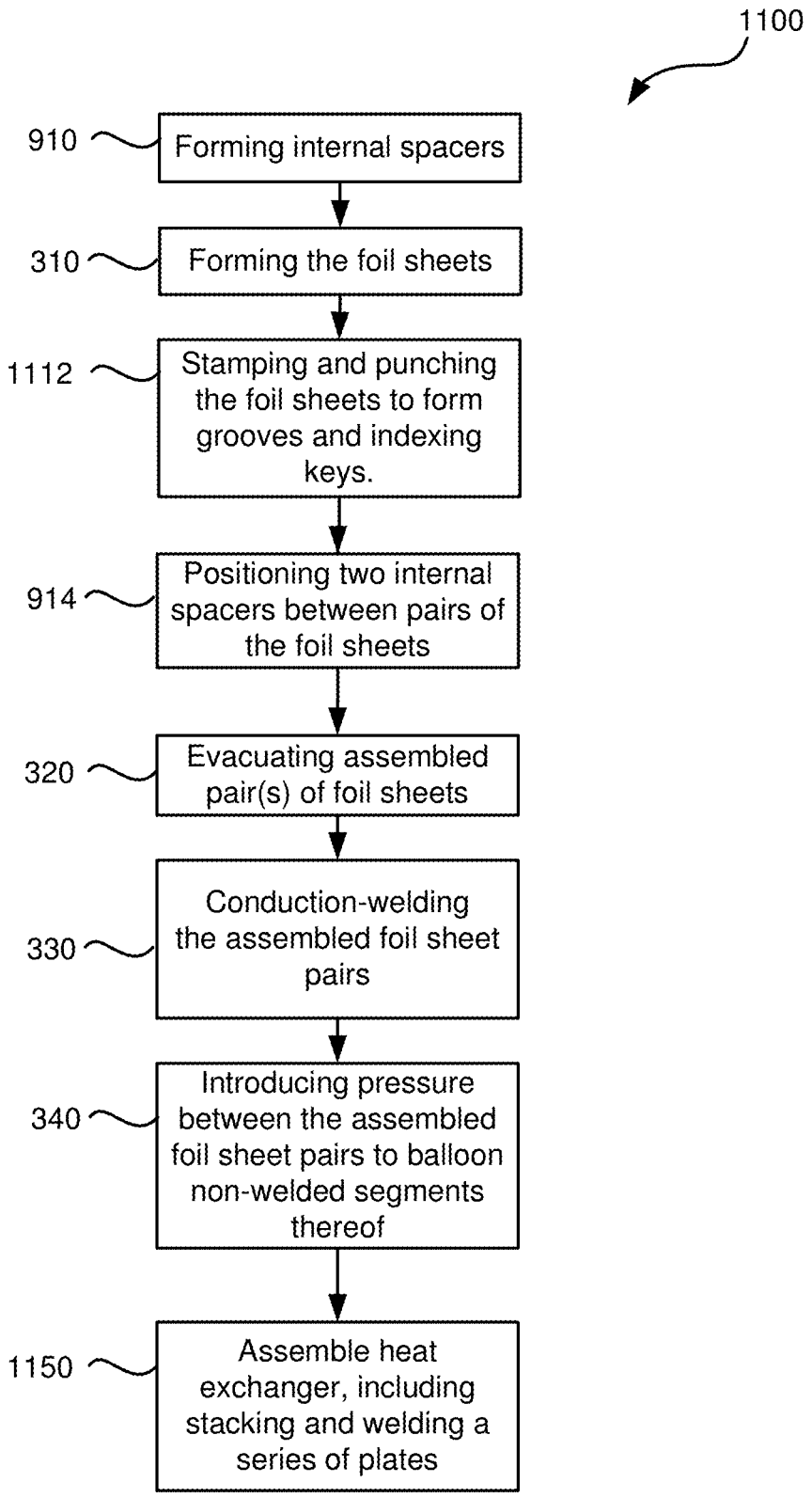
FIG. 11 is a process flow diagram of a method of making a heat exchanger with stacked foil-formed manifold plates without O-rings according to an embodiment.

FIG. 11 illustrates a method 1100 of making a heat exchanger according to some embodiments, which includes forming a series of single port axial manifold plate assemblies without O-rings, as described above with reference to FIG. 10. In the method 1100, the heat exchanger may be made by performing operations 310, 320, 330, and 340 of the method 300, as well as operations 910 and 914 of the method 900 as described above.

Between operations 310 and 914 of the method 900 described above, in operation 1112, the foil sheets may be stamped to form grooves for the internal spacer (e.g., 420 in FIG. 4B). Unlike operation 912 of the method 900, grooves need not be formed for upper or lower gaskets. Also as part of operation 1112, the foil sheets may be punched to form indexing keys for properly orienting the internal spacer.

In operation 1150, a series of the plates may be stacked and welded together. In operation 1150, the plates may be stacked and welded, braised, adhered or otherwise bonded together without O-rings between them. The series of stacked plates may be otherwise positioned in a heat exchanger housing similar to that described above with regard to operation 950 of the method 900.

Figure 12A:
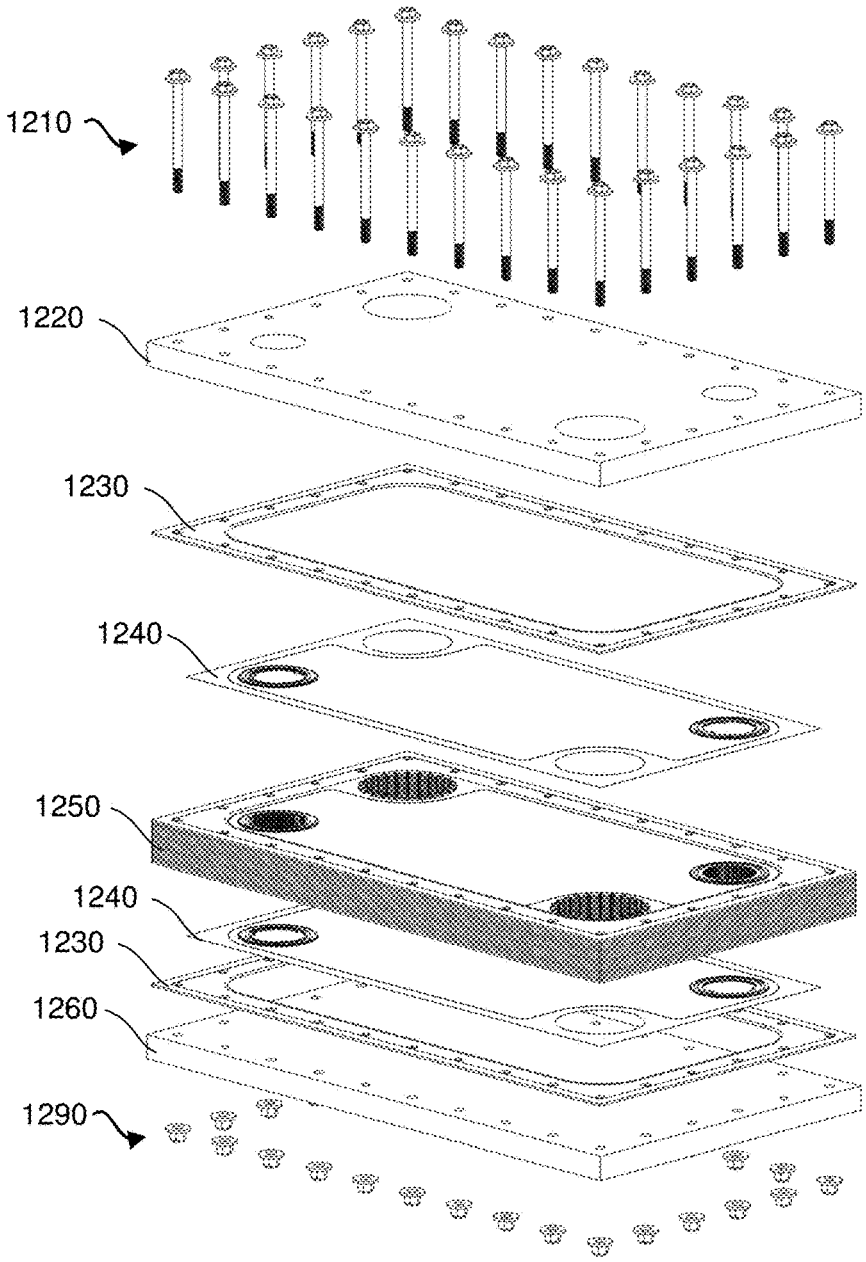
FIG. 12A is an isometric exploded view of a heat exchanger assembly according to an embodiment.
Figure 12B:
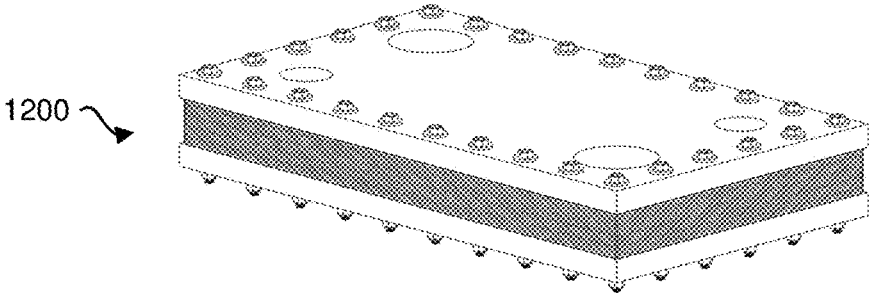
FIG. 12B is an isometric view of the heat exchanger assembly of FIG. 12A, fully assembled.

FIGS. 12A and 12B illustrate a formed heat exchanger assembly 1200 in accordance with various embodiments. FIG. 12A shows an exploded view of a heat exchanger assembly 1200, while FIG. 12B shows an assembled version of the plate assembly 1200 in FIG. 12A.

In accordance with various embodiments, the heat exchanger assembly 1200 may include, in order: a header plate 1220, a perimeter gasket 1230 (which may be included at each layer), a thin-foil plate with O-ring 1240, a series of stacked bonded twin-thin foil plates 1250, another thin-foil plate with O-ring, another perimeter gasket 1230, and a follower plate 1260. Additionally, the heat exchanger assembly 1200 may be held together with a set of through bolts 1210 configured to pass through the assembly and be secured at the opposite end by mating nuts 1290.

Figure 13:
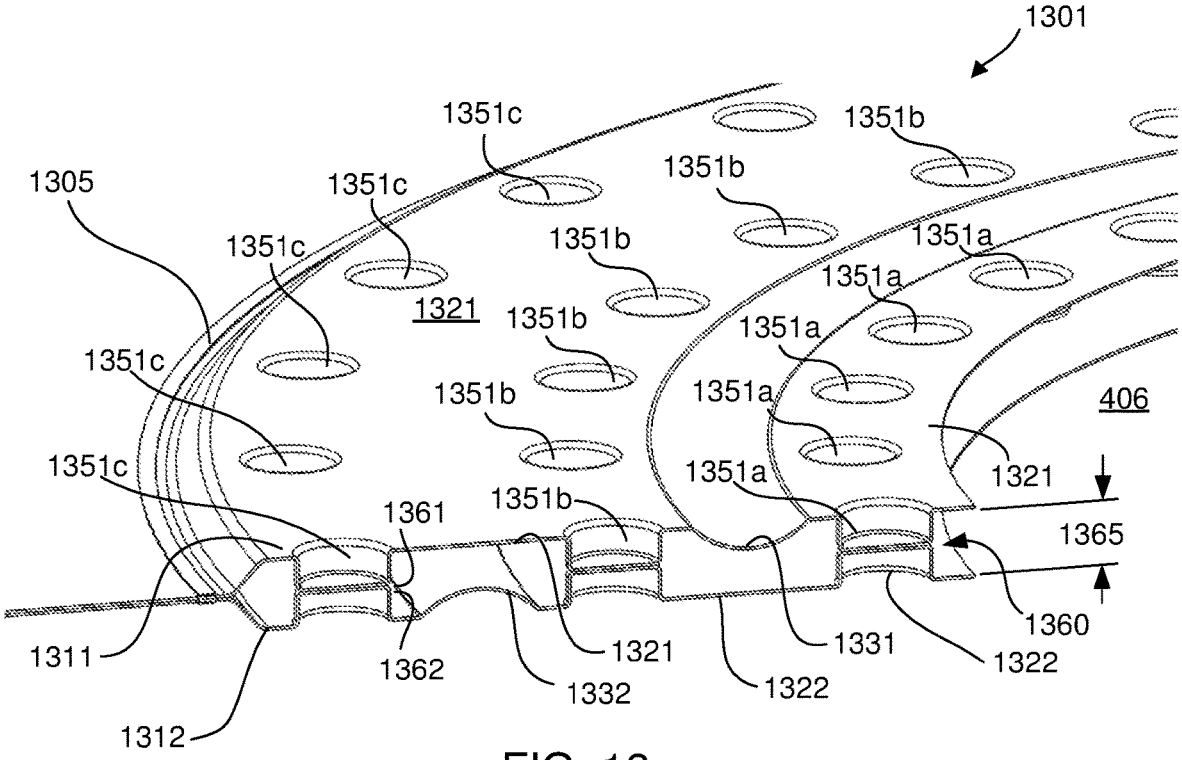
FIG. 13 is a cross-sectional isometric view of a portion of a pair of foil sheets from a foil-formed manifold plate that includes a series of recesses forming spacers between the pair of foil sheets in accordance with an embodiment.

FIG. 13 illustrates a portion of a pair of foil sheets 1311, 1312 that make up a foil-formed manifold plate 1301, which includes a series of recesses forming spacers between the pair of foil sheets in accordance with an embodiment. In this embodiment, the foil-formed manifold plate 1301 eliminates the need for a spacer between the two foil sheets 1311, 1312, which may reduce materials, fabrication steps, and thus costs of manufacture. In addition, during the stacking process in which multiple foil-formed manifold plates are stacked to form a heat exchanger, the formed features of the two foil sheets 1311, 1312 may supply the needed compression support.

In FIG. 13 shows an isolated view of one side of one outlet port 406 (e.g., FIG. 4A) in a plate assembly separated from other stacked plate assemblies above and/or below it. The isolated foil-formed manifold plate 1301 includes portions of two foil sheets 1311, 1312. Outer planar surfaces 1321, 1322, facing away from one another, of the two foil sheets 1311, 1312 may each include an outer planar surface 1321, 1322, respectively, and a series of outwardly-facing recesses 1351*a*, 1351*b*, 1351*c*. Each of the outwardly-facing recesses is formed by a depressed portion set back from the planar surface 1321, 1322. Also, when the two foil sheets are stacked and properly aligned, as shown in FIG. 13, the backs of the outwardly-facing recesses from one of the two foil sheets (e.g., 1311) should line-up and abut the backs of the outwardly-facing recesses from the other one of the two foil sheets (e.g., 1312), thereby together forming spacer legs 1360. For example, the two foil sheets 1311, 1312 may be integrally formed with spacer legs from a back surface 1361, 1362 of each of the series of outwardly-facing recesses 1351*a*, 1351*b*, 1351*c* in one of the two foil sheets 1311, 1312 abutting a back surface 1362, 1361 of a corresponding one of the series of outwardly-facing recesses 1351*a*, 1351*b*, 1351*c* in the other of the two foil sheets 1312, 1311. In particular, when the two foil sheets 1311, 1312 are joined to form a foil-formed manifold plate 1301, a first back surface 1361 of one outwardly-facing recess (e.g., 1351*c*) in a first foil sheet 1311 abuts a second back surface 1362 of another outwardly-facing recess (e.g., 1351*c*) in a second foil sheet 1312, and together those abutting recesses form one spacer leg 1360. The height 1365 of the spacer legs 1360 may be modified by changing the depth of the outwardly-facing recesses 1351*a*, 1351*b*, 1351*c* during manufacturing and forming of the foil sheets 1311, 1312. In some embodiments, each of the series of outwardly-facing recesses 1351*a*, 1351*b*, 1351*c* may have a round perimeter, forming a cylindrical cup-shape. In this way, the depressed portion of each of the series of outwardly-facing recesses 1351*a*, 1351*b*, 1351*c* may include a flat bottom. Alternatively, some or all of the outwardly-facing recesses may have a semi-spherical shape, formed like dimples in the planar surfaces 1321, 1322. The outwardly-facing recesses 1351*a*, 1351*b*, 1351*c* may be formed into almost any shape. Regardless of the shape of the outwardly-facing recesses 1351*a*, 1351*b*, 1351*c*, the back surfaces 1361, 1362 of opposed recesses should be configured to engage one another (i.e., abutting) forming spacers that maintain a desired amount of space between the planar surfaces 1321, 1322 of the two foil sheets 1311, 1312. In this way, when stacked to form one foil-formed manifold plate 1301, the outwardly-facing recesses 1351*a*, 1351*b*, 1351*c* in one sheet (e.g., 1311) will face in the opposite direction to the outwardly-facing recesses 1351*a*, 1351*b*, 1351*c* in the adjacent sheet (e.g., 1312).

In various embodiments, the series of outwardly-facing recesses 1351*a*, 1351*b*, 1351*c* in each of the two foil sheets 1311, 1312 may surround the inlet and outlet ports (e.g., 405, 406). Also, the outwardly-facing recesses 1351*a*, 1351*b*, 1351*c* in each of the two foil sheets 1311, 1312 may be arranged in concentric rows. For example, the foil sheets 1311, 1312 may include an inner-most row of outwardly-facing recesses 1351*a*, a middle row of outwardly-facing recesses 1351*b*, and an outer-most row of outwardly-facing recesses 1351*c*.

The two foil sheets 1311, 1312 may additionally include annular grooves 1331, 1332 configured to receive O-rings therein for providing a seal between two stacked foil-formed manifold plates 1301. In addition, a seal weld 1305 may provide a seal between the two foil sheets 1311, 1312. Since the seal weld 1305 is preferably disposed along a perimeter of the foil-formed manifold plate 1301, excess material beyond the seal weld 1305 (i.e., on the left side of the seal weld 1305 in the configuration shown in FIG. 13) may be trimmed away. The two foil sheets 1311, 1312 may be formed with some variations, such that the annular grooves 1331, 1332 in the two foil sheets 1311, 1312 of one foil-formed manifold plate 1301 may be radially offset from one another, relative to a vertical central axis of one of the inlet and outlet ports (e.g., 405, 406). For example, a first foil sheet 1311 may be formed with a first annular groove 1331 facing in a first direction (e.g., upward), that is positioned radially inward of a second annular groove 1332, in the second foil sheet 1312, facing in a second direction (e.g., downward) that is opposite the first direction. Thus, when the two foil sheets 1311, 1312 are assembled into the foil-formed manifold plate 1301, a backside of the first annular groove 1331 in the first foil sheet 1311 may be axially aligned with a planar portion 1322 of the second foil sheet 1312. Also once assembled, a backside of the second annular groove 1332 in the second foil sheet 1312 may be axially aligned with a planar portion 1321 of the first foil sheet 1311.

Figure 14A:
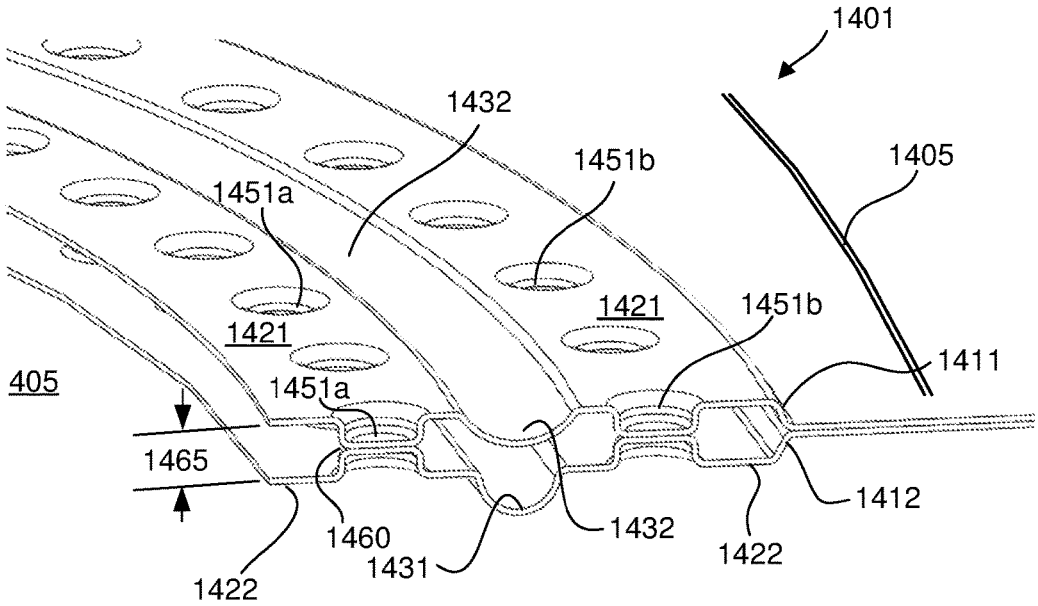
FIG. 14A is a cross-sectional isometric view of a portion of a pair of foil sheets from a foil-formed manifold plate that includes axially aligned annular grooves in the pair of foil sheets in accordance with an embodiment.
Figure 14B:
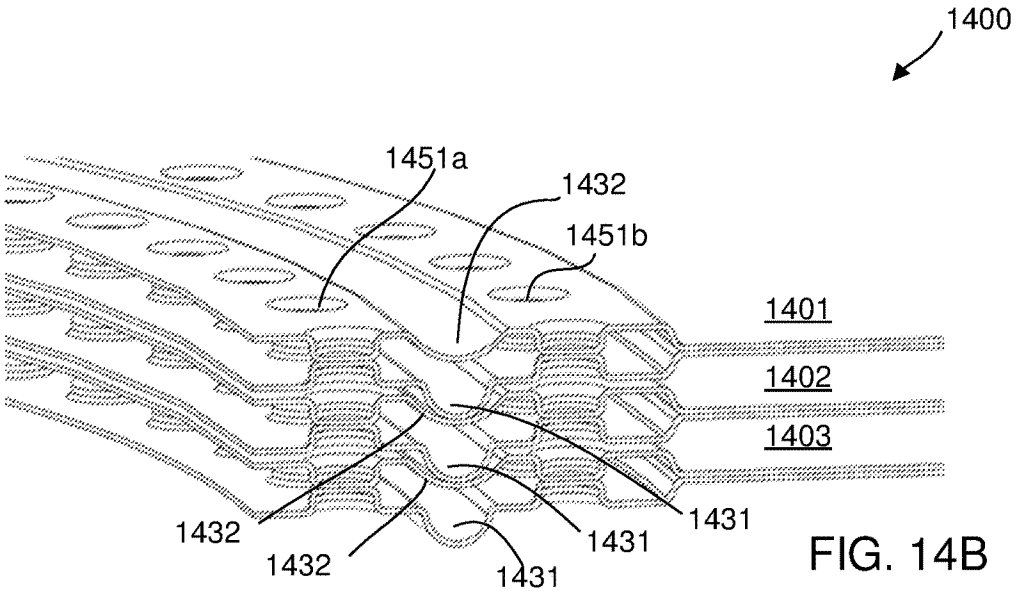
FIG. 14B is a cross-sectional isometric view of three of the pairs of foil sheets of FIG. 14A in a stack with an under-side of an annular groove of one pair of foil sheets received inside an upper-side of another pair of foil sheets in accordance with an embodiment.
Figure 14C:
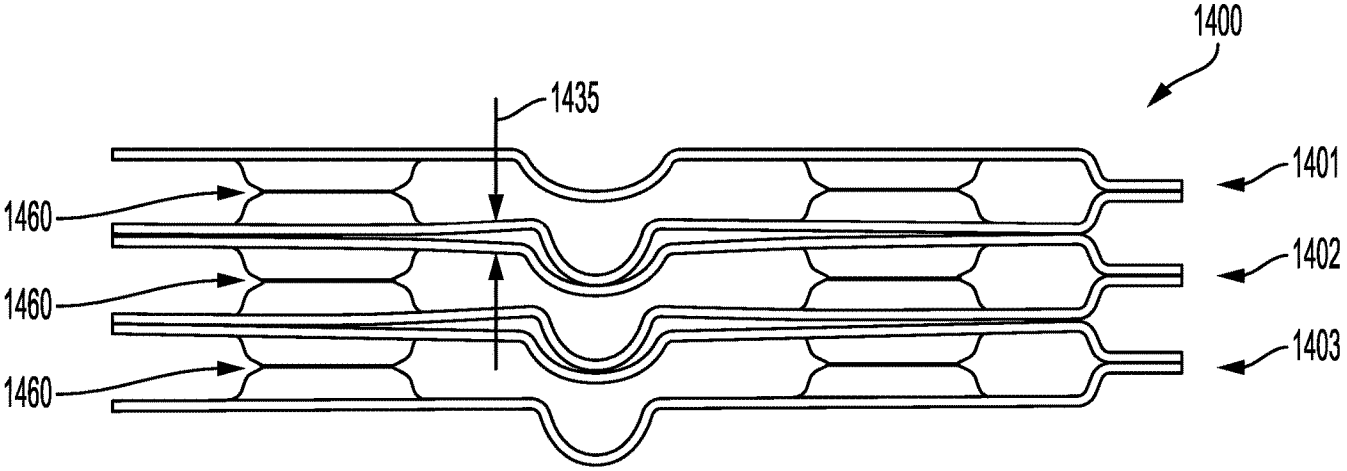
FIG. 14C is a cross-sectional side view of the three pairs of foil sheets of FIG. 14B.

FIGS. 14A-14C illustrate portions of foil-formed manifold plates, prior to pressurization, in accordance with some embodiments. In particular, FIGS. 14A-14C illustrate a portion of one or more pairs of foil sheets, adjacent an inlet port (e.g., FIG. 4A), in a plate assembly separated from other stacked plate assemblies above and/or below. In FIG. 14A, the isolated foil-formed manifold plate 1401 not only eliminates the need for a spacer between the two foil sheets 1411, 1412, but may also eliminate the need for O-rings (i.e., gaskets) between the foil-formed manifold plates. Eliminating the O-rings may further reduce materials, fabrication steps, and costs. In this embodiment, during the stacking process in which multiple foil-formed manifold plates are stacked to form a heat exchanger, the formed features of the two foil sheets 1411, 1412 may supply a level of compression support that, together with a seal weld 1405 at a perimeter, forming a continuous bond that ensures a seal between plates (i.e., a continuous seal).

The compression supports are similar to the "spacer legs" described above, which are columns formed in the foil. The foil-formed manifold plate 1401 is formed from two foil sheets 1411, 1412, each of which includes a planar surface 1421, 1422, respectively, and a series of outwardly-facing recesses 1451*a*, 1451*b*. Each of the outwardly-facing recesses 1451*a*, 1451*b* is formed by a depressed portion set back from the outer planar surface 1421, 1422. Also, when the two foil sheets 1411, 1412 are stacked and properly aligned (i.e., assembled), as shown in FIG. 14A, the backs of the recesses from one of the two foil sheets (e.g., 1411) should line-up and abut the backs of the recesses from the other of the two foil sheets (e.g., 1412). For example, when the two foil sheets 1411, 1412 are joined to form a foil-formed manifold plate 1401, a first back surface of one outwardly-facing recess (e.g., 1451*a*) in a first foil sheet 1411 abuts a second back surface of another outwardly-facing recess (e.g., 1451*a*) in a second foil sheet 1412, together forming spacer legs 1460. Otherwise, the outwardly-facing recesses 1451*a*, 1451*b* may be similar to the outwardly-facing recesses (e.g., 1351*a*, 1351*b*, 1351*c*) described with regard to the foil-formed manifold plate (e.g., 1301) and variations thereof shown in FIG. 13.

The seal feature of the foil-formed manifold plate 1401 may include a male annular groove 1431 and a female annular groove 1432 that both sit between two circumferential rows of outwardly-facing recesses 1451*a*, 1451*b*. The male and female annular grooves 1431, 1432 may be axially aligned relative to a central axis of one of the inlet and outlet ports (e.g., 405, 406). Also, the male and female annular grooves 1431, 1432 may face in the same direction when assembled. In this way, a first open depression of the female annular groove 1432 in a first foil sheet 1411 will face away from the second sheet 1412 and a second open depression of the male annular groove 1431 faces toward the first foil sheet 1411. In addition, the male annular groove 1431 may be slightly deeper and narrower than the female annular groove 1432, which ensures the male annular groove 1431 from one plate (e.g., 1401) will be received in the female annular groove 1432 of an adjacent plate (e.g., 1402). Alternatively or additionally, the arched cross-section of the male annular groove 1431 may have a slightly smaller radius than the arched cross-section of the female annular groove 1432. Also, a back surface of the male annular groove 1431 from the one plate may make contact with and may provide a metal-to-metal seal with the inside bottom of the female annular groove 1432 of the other plate when the plates are stacked into a heat exchanger. When manufacturing the foil-formed manifold plates, the compression force providing the metal-to-metal seal between foil-formed manifold plates may be controlled by choosing a depth difference between the male and female annular grooves 1431, 1432 and the spacing 1465 between planar surfaces maintained by the spacer legs 1460. In this way, the effectiveness of a metal-to-metal seal may be tuned to the particular foil material and thickness in a particular heat exchanger design or application. The inherent smoothness of the foil from the rolling process may ensure that a good seal can be maintained. Alternatively or additionally, an adhesive, sealing agent, and/or seal-weld may be applied between the engagement surfaces to achieve an effective seal, which may be a metal-to-metal seal that is aided of enhanced by a sealing agent and/or seal welding.

FIGS. 14B and 14C illustrate a series 1400 of plates 1401, 1402, 1403 in a stacked configuration, according to various embodiments. In FIGS. 14B and 14C, the engagement by the underside of the male annular groove 1431 of upper ones of the series of plates (e.g., 1401, 1402) inside the female annular groove 1432 of corresponding lower ones of the series of plates (e.g., 1402, 1403) may deflect a portion of the planar surface of the foil sheet in which the male annular groove 1431 is formed. This deflection may form a slight gap 1435 between the adjoining foil sheets 1411, 1412 from adjacent foil-formed manifold plates 1401, 1402, 1403.

Figure 15:
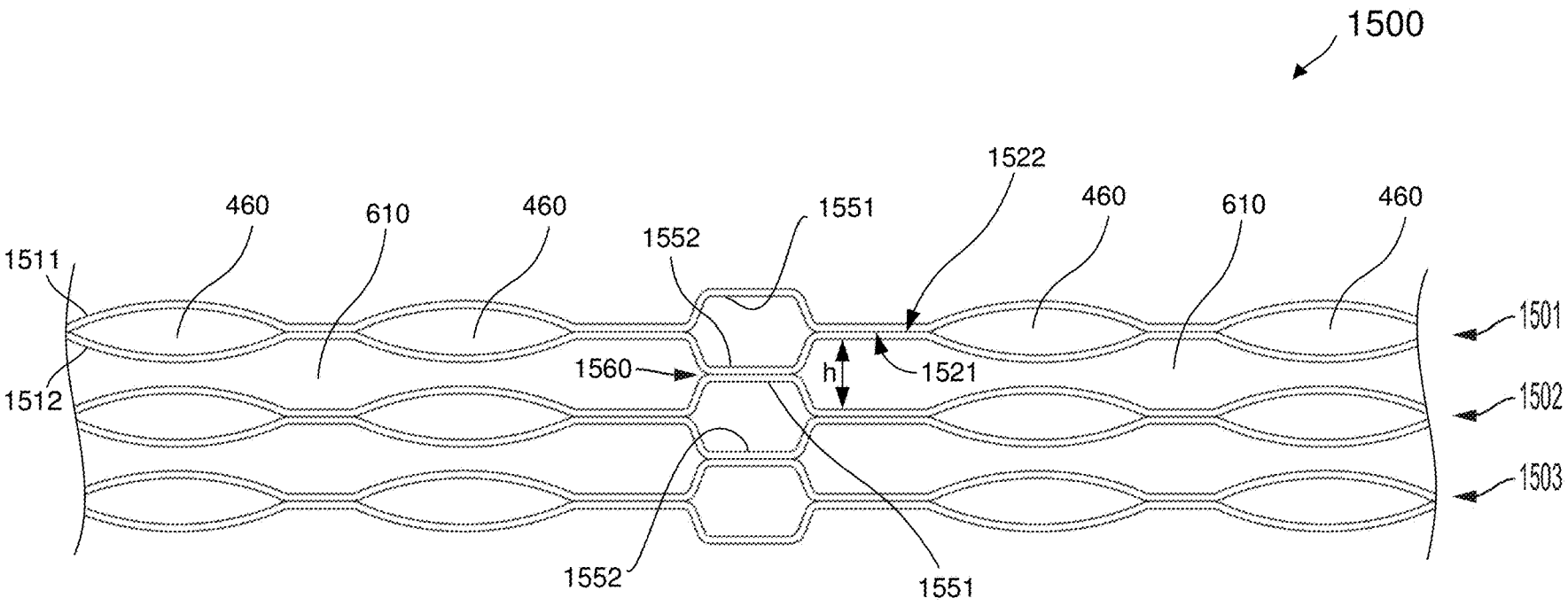
FIG. 15 is a cross-sectional side view of three pairs of foil sheets with interstitial spacer legs between adjacent pairs of foil sheets in accordance with an embodiment.

FIG. 15 shows an isolated view of a portion of an inner region of a series 1500 of plate assemblies 1501, 1502, 1503 in a stacked configuration with interstitial legs between adjacent plates in accordance with an embodiment. The inner regions (e.g., 1500) of the pairs of foil sheets refer to those portions of the foil sheets not immediately adjacent the outermost perimeter of the sheets or the inlet or outlet ports. Each plate assembly (e.g., 1501) includes two foil sheets 1511, 1512. As described above, when manufacturing the plate assembles, pressure may be introduced between the two foil sheets 1511, 1512 to expand portions of the individual plates in locations where the two foil sheets 1511, 1512 are not bonded together. While the bonded locations remain engaged, the areas of foil between and around the bonded locations yield from the pressure and balloon, separating the two thin metal sheets 1511, 1512 from one another to form internal plate passages 460 (also shown in FIGS. 6C and 10).

In addition, inner planar surfaces 1521, 1522 of the two foil sheets 1511, 1512 facing toward one another may each include inwardly-facing recesses 1551, 1552, the backs of which protrude outwardly in opposite directions of the respective plate assembly. Each of the inwardly-facing recesses 1551, 1552 may be formed by a depressed portion set back from the inner planar surface 1521, 1522, respectively. Also, when the plate assemblies 1501, 1502, 1503 are stacked and properly aligned, as shown in FIG. 15, the backs of the inwardly-facing recesses (e.g., 1552) from one of the plate assemblies (e.g., 1501) should line-up and abut the backs of the inwardly-facing recesses (e.g., 1551) from an adjacent one of the plate assemblies (e.g., 1502), thereby together forming interstitial spacer legs 1560. The interstitial spacer legs 1560 maintain the space that forms the interstitial channels 610 (also shown in FIGS. 6C and 10) in this embodiment. The interstitial spacer legs 1560 may facilitate the stacking of the series of plate 1501, 1502, 1503, since they eliminate the need for an additional spacer element. A height h of the interstitial spacer legs 1560 may be modified by changing the depth of the inwardly-facing recesses 1551, 1552 during manufacturing and forming of the foil sheets 1511, 1512. In some embodiments, each of the series of inwardly-facing recesses 1551, 1552 may have a round perimeter, forming a cylindrical cup-shape. In this way, the depressed portion of each of the series of inwardly-facing recesses 1551, 1552 may include a flat bottom. Alternatively, some or all of the inwardly-facing recesses may have a semi-spherical shape, formed like dimples in the planar surfaces 1521, 1522. The inwardly-facing recesses 1551, 1552 may be formed into almost any shape. Regardless of the shape of the inwardly-facing recesses 1551, 1552, the back surfaces thereof may be configured to engage back surfaces of inwardly-facing recesses 1551, 1552 from an adjacent plate assembly to form interstitial spacers that maintain a desired amount of space between the plate assemblies 1501, 1502, 1503.

Figure 16:
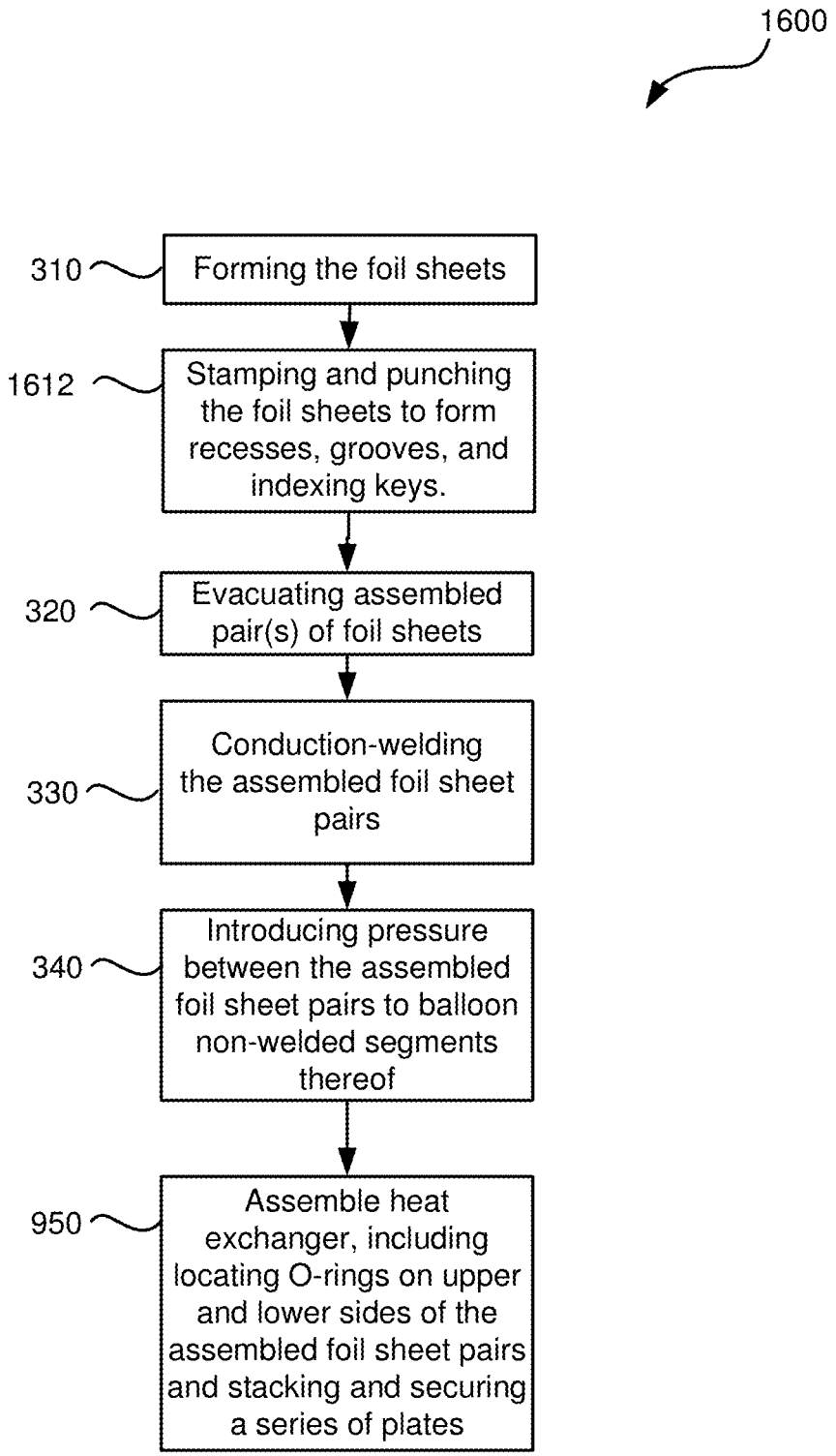
FIG. 16 is a process flow diagram of a method of making a heat exchanger with stacked foil-formed manifold plates without spacers in accordance with an embodiment.

FIG. 16 illustrates a method 1600 of making a heat exchanger according to some embodiments, which includes forming a series of manifold plate assemblies without spacers, as described above with reference to FIG. 9.

In the method 1600, the heat exchanger may be fabricated by performing operations 310, 320, 330, 340 of the method 300, and operation 950 of the method 900 as described above. In operation 1612, which may be performed after operation 310 and before operation 320 of the method 300 described above, the foil sheets may be stamped to form recesses (e.g., 1351*a*, 1351*b*, 1351*c* in FIG. 13 and/or 1551, 1552 in FIG. 15) and grooves (e.g., 1331, 1332 in FIG. 13). Also, as part of operation 1612, the foil sheets may be punched to form indexing keys for properly aligning the recesses that form spacer legs.

The method may then include performance of operations 320, 330 and 340 of the method 300 as described above. Finally, the series of stacked plates may be positioned in a heat exchanger housing in operation 950 of the method 900 as described above.

Figure 17:
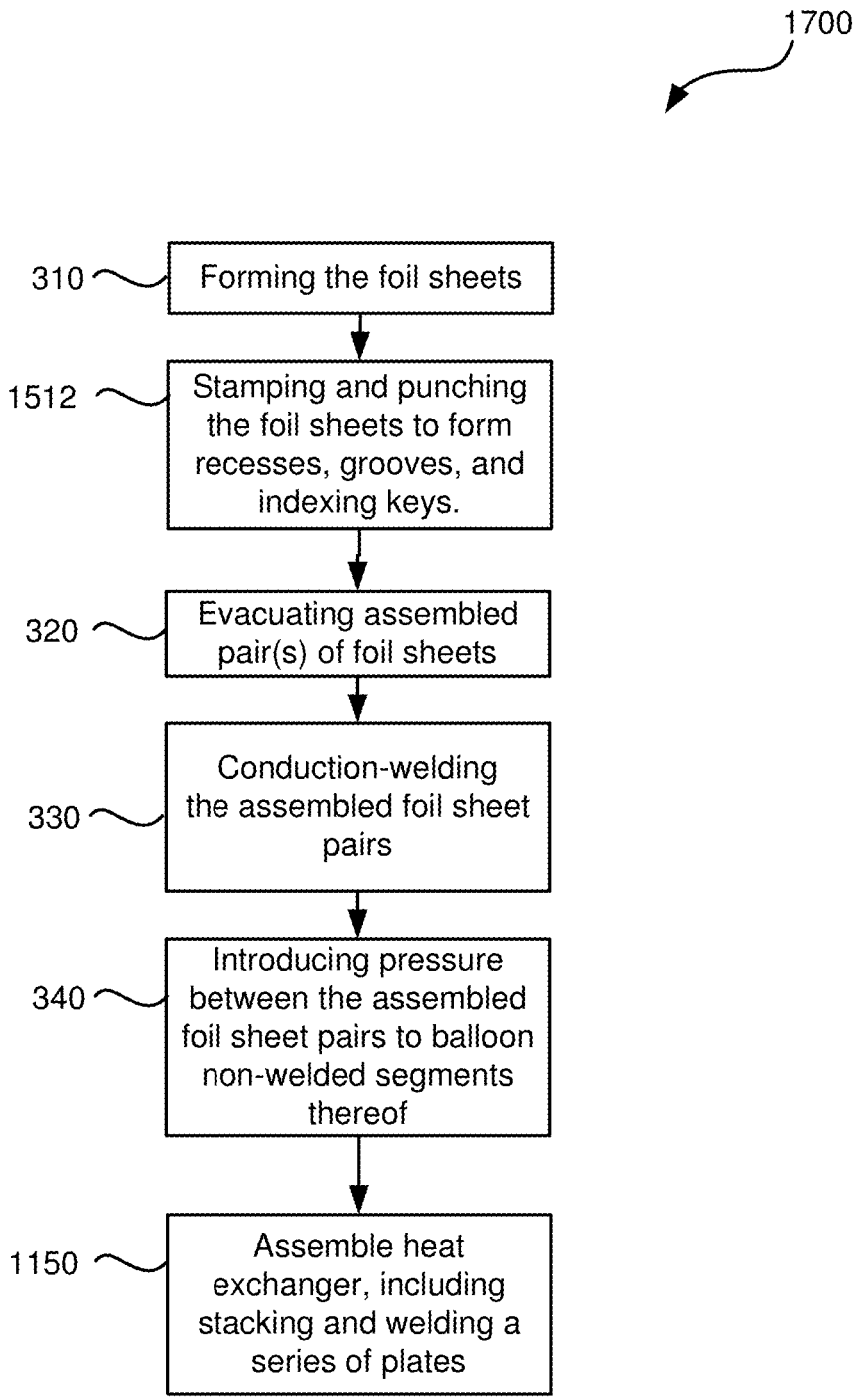
FIG. 17 is a process flow diagram of a method of making a heat exchanger with stacked foil-formed manifold plates without spacers or O-rings in accordance with an embodiment.

FIG. 17 illustrates a method 1700 of making a heat exchanger according to some embodiments, which includes forming a series of manifold plate assemblies without spacers or O-rings, as described above with reference to FIG. 11. In the method 1700, the heat exchanger may be fabricated by performing operation 310 of the method 300, operation 1612 of the method 1600, operations 320, 330, and 340 of the method 300, and finally operation 1150 of the method 1100 for stacking and welding the series of plates as described above.

In accordance with various embodiments, a shape of a perimeter of the foil sheets and the corresponding plate assembly may be unique and different from the length and width dimensions of the raw material foil sheets used in the assembly. By trimming excess material outside a perimeter seal-weld of a plate assembly, any shape that can be traced when forming the perimeter seal-weld (i.e., tracing a weld-path) may be the finished shape of the perimeter of the plate assembly. Additionally or alternatively, the shape of the individual inlet and outlet ports may be similarly customized.

Figure 18A:
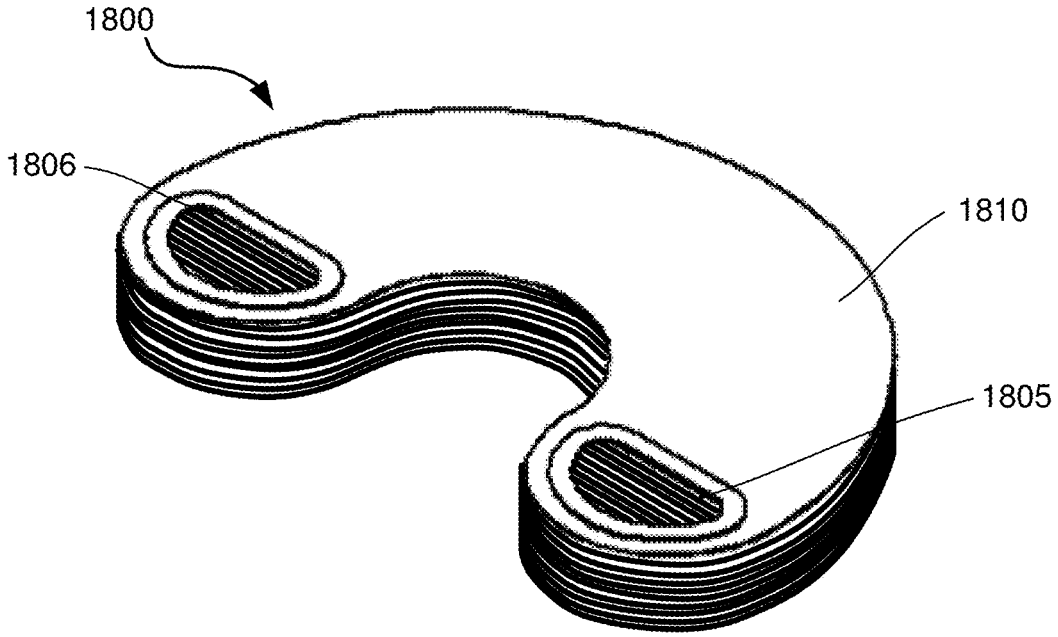
FIG. 18A is an isometric view of a stacked series of C-shaped foil-formed manifold plates from 6A according to an embodiment.
Figure 18B:
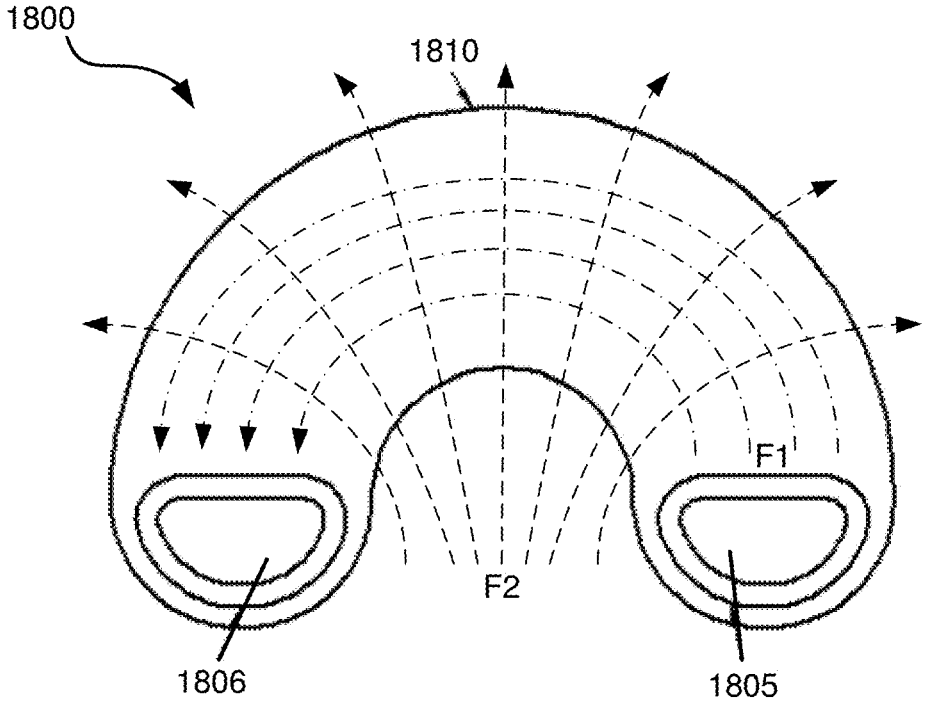
FIG. 18B is a top view of the stacked series of C-shaped foil-formed manifold plates from FIG. 18A, showing fluid flow lines for two different fluids according to an embodiment.

As an example, FIGS. 18A and 18B illustrate a stacked series of plates 1800 of uniquely-shaped single port axial manifold plates with D-shaped inlet/outlet ports 1805, 1806, in accordance with various embodiments. The stacked series of plates 1800 may be formed by a plurality of individual single port axial manifold plates 1810 assembled into a stack. Each of the individual single port axial manifold plates 1810 may be formed in a generally C-shape, which gives the stacked series of plates 1800 a C-shape when viewed from a top view (i.e., FIG. 18B). The stacked series of plates 1800 may include combined inlet and outlet ports 1805, 1806 formed by the axial alignment of the respective inlet and outlet ports (e.g., 405, 406 in FIG. 4A) of the individual plates 1810.

FIG. 18B additionally illustrates the flow of two different fluids through the stacked series of plates 1800, in accordance with various embodiments. A first fluid F1 is shown flowing into the combined inlet port 1805, through internal plate passages (e.g., 460 in FIGS. 6C and 10), and out of the combined outlet port 1806. In contrast, a second fluid F2 is shown flowing across the stacked series of plates 1800 through the interstitial channels (e.g., 610 in FIGS. 6C and 10).

Various embodiments may sustain high pressures (e.g., 1,000 psi) by selecting the material thickness of the foil sheets, spacers, and/or O-rings, and adjusting the bonding pattern of the series of conduction-welding spots between the two foil sheets. Thus, the various embodiments may have particular application to settings using refrigerants, which are associated with high pressure fluids flowing through the internal plate passages. The secondary fluid being cooled and which flows between the plates in the interstitial channels may be air, water, glycol, oil, or any fluid that acts as a coolant.

Various embodiments include heat exchanger designs that provide 2-8 times improvement in efficiency and heat transfer area compared to conventional heat exchangers, depending on the application. In addition, using ultra-thin foils to form the plates without the need for bulky manifolds, the various embodiments provide a heat exchanger that is orders of magnitude lighter than conventional heat exchangers of comparable size.

Various embodiments enable heat exchanger design shapes that are non-rectilinear. For example, manifolds need not have circular cross-sections and may be configured in practically any shape that can be traced during perimeter welding processes, as illustrated in FIGS. 18A and 18B. Further, uniquely shaped heat exchangers may be fabricated in this manner without the need for unique tooling, thereby enabling the cost-effective manufacture of limited numbers of heat exchangers designed to fit in confined spaces. The ability to form efficient heat exchangers with practically any shape enable heat exchangers of various embodiments to be implemented in many applications in which conventional heat exchangers cannot fit.

Ultra-compact thin-foil heat exchangers, according to various embodiments, may achieve more heat transfer per cubic meter compared to conventional and current marketplace plate heat exchanger designs. In addition, the ultra-compact thin-foil heat exchangers of various embodiments have a self-sufficient internal support structure that resists compression from external forces or expansion from internal pressure. In contrast, conventional plate heat exchanger designs require an external frame to resist compression or expansion. The internal support structure of ultra-compact thin-foil heat exchangers according to various embodiments may be more easily adaptable to various setting. For example, by changing the thickness of the internal spacers, various embodiments may be adapted to larger or smaller environments.

The preceding description of the disclosed embodiments is provided to enable any person skilled in the art to make or use the claims. Various modifications to these embodiments will be readily apparent to those skilled in the art, and the generic principles defined herein may be applied to other embodiments without departing from the scope of the claims. Thus, the claims not intended to be limited to the embodiments shown herein but is to be accorded the widest scope consistent with the language of the following claims and the principles and novel features disclosed herein.

What is claimed is:

1. A heat-exchanger, comprising:

a series of plates stacked on one another, wherein each of the plates comprises:

two foil sheets bonded together at a series of spaced apart bonding locations across a planar extent of the two foil sheets in a pattern wherein internal plate passages are formed between the two foil sheets that allow the flow of a first fluid between the two foil sheets in regions where the two foil sheets are not bonded, an inlet port and an outlet port, each located at opposite ends of the planar extent of the two foil sheets, wherein each of the inlet and outlet ports extend through the two foil sheets perpendicular to the planar extent of the two foil sheets, wherein the inlet and outlet ports provide access for the first fluid to flow into and out of the internal plate passages, and an internal spacer sandwiched between the two foil sheets at each of the inlet and outlet ports, wherein the internal spacer includes:

a connection ring that surrounds an inner diameter of the inlet and outlet ports; and a series of radial teeth that extend radially from the connection ring, wherein the two foil sheets directly engage the series of radial teeth and at least one of the two foil sheets does not engage the connection ring forming a series of serpentine flow paths for the first fluid, wherein each of the series of serpentine flow paths extend between pairs of the series of radial teeth and over or under the connection ring, wherein interstitial channels are formed between the series of plates, wherein the interstitial channels are configured to allow the flow of a second fluid between the series of plates, wherein the first and second fluids are isolated from one another.

2. The heat-exchanger of claim 1, wherein the series of radial teeth extend radially inward from the connection ring toward the inner diameter of the inlet and outlet ports.

3. The heat-exchanger of claim 1, wherein the internal spacer includes an indexing key for maintaining a specific orientation between the internal spacer and the two foil sheets.

4. The heat-exchanger of claim 1, wherein each of the two foil sheets includes a plurality of annular grooves surrounding the inlet and outlet ports, wherein each of the plurality of annular grooves form a recess in an outer planar surface of the respective one of the two foil sheets and a protrusion in an inner planar surface opposed to the outer planar surface, wherein the protrusion is configured to be received in and hold the internal spacer between the two foil sheets.

5. The heat-exchanger of claim 4, wherein each of the plates further comprises:

a gasket mounted on each of opposed faces of each of the inlet and outlet ports, wherein the gaskets are at least partially disposed in the plurality of annular grooves and disposed between the series of plates stacked on one another.

6. The heat-exchanger of claim 4, wherein:

a first annular groove of the plurality of annular grooves is radially offset from a second annular groove of the plurality of annular grooves;

the first annular groove surrounds one of the inlet or outlet ports on one of the two sheets; and the second annular groove surrounds the same one of the inlet or outlet ports on the other of the two sheets.

7. The heat-exchanger of claim 1, wherein an outer thickness of the two foil sheets with the internal spacer there between is between 0.2-2.0 millimeters thick.

8. The heat-exchanger of claim 1, wherein each of the inlet and outlet ports is formed by a ring bonded to the two foil sheets and configured to allow the first fluid to flow past a peripheral extent of the ring and through the internal plate passages.

9. The heat-exchanger of claim 1, wherein a central axis of the inlet and outlet ports of a first one of the series of plates is offset from a central axis of the inlet and outlet ports of a second one of the series of plates.

10. The heat-exchanger of claim 1, wherein the series of plates stacked on one another are bonded together by sealing welds between each of the series of plates.

11. The heat-exchanger of claim 1, wherein a continuous bond is formed around a perimeter of the two foil sheets for containing the first fluid.

12. The heat-exchanger of claim 1, wherein each of the two foil sheets includes an inner planar surface and a series of inwardly-facing recesses, wherein the inner planar surfaces of the two foil sheets face toward one another;

each of the inwardly-facing recesses is formed by a depressed portion set back from the inner planar surface; and the series of plates are stacked such that back surfaces of the inwardly-facing recesses in one of the series of plates abut back surfaces of corresponding inwardly-facing recesses in an adjacent other one of the series of plates.

13. The heat-exchanger of claim 1, wherein each of the two foil sheets includes an outer planar surface and a series of outwardly-facing recesses, wherein the outer planar surfaces of the two foil sheets face away from one another;

each of the outwardly-facing recesses is formed by a depressed portion set back from the outer planar surface; and the two foil sheets are configured such that a back surface of each of the outwardly-facing recesses in one of the two foil sheets abut a back surface of a corresponding one of the outwardly-facing recesses in the other of the two foil sheets.

14. The heat-exchanger of claim 13, wherein each of the series of outwardly-facing recesses includes a round perimeter.

15. The heat-exchanger of claim 13, wherein the depressed portion of each of the series of outwardly-facing recesses includes a flat bottom.

16. The heat-exchanger of claim 13, wherein the abutting series of outwardly-facing recesses of the two foil sheets form spacers between the planar surfaces of the two foil sheets.

17. The heat-exchanger of claim 13, wherein the series of outwardly-facing recesses in each of the two foil sheets surround the inlet and outlet ports.

18. The heat-exchanger of claim 13, wherein the outwardly-facing recesses in each of the two foil sheets are arranged in concentric rows.

19. The heat-exchanger of claim 13, wherein a first sheet of the two foil sheets includes a first annular groove having a first open depression and a second sheet of the two foil sheets includes a second annular groove having a second open depression, wherein the first and second annular grooves are axially aligned relative to a central axis of one of the inlet or outlet ports.

20. The heat-exchanger of claim 19, wherein:

the first annular groove is formed in the first sheet so that the first open depression of the first annular groove faces away from the second sheet when the two foil sheets are assembled; and the second annular groove is formed in the second sheet so that the second open depression of the second annular groove faces toward the first sheet when the two foil sheets are assembled.

21. The heat-exchanger of claim 19, wherein the first annular groove includes a first depth and the second annular groove includes a second depth that is greater than the first depth.

22. The heat-exchanger of claim 19, wherein an underside of the second annular groove of a first one of the series of plates is received inside the first annular groove of a second one of the series of plates.

23. The heat-exchanger of claim 22, wherein an engagement by the underside of the second annular groove of the first one of the series of plates inside the first annular groove of the second one of the series of plates deflects a portion of the planar surface of the second sheet of the first one of the series of plates when the heat-exchanger is assembled.

24. The heat-exchanger of claim 22, wherein an engagement by the underside of the second annular groove of the first one of the series of plates inside the first annular groove of the second one of the series of plates provides a continuous seal between the first and second ones of the series of plates.

* * * * *